US010968604B2

(12) United States Patent
Imura et al.

(10) Patent No.: US 10,968,604 B2
(45) Date of Patent: Apr. 6, 2021

(54) WORK MACHINE

(71) Applicant: Hitachi Construction Machinery Co., Ltd., Tokyo (JP)

(72) Inventors: Shinya Imura, Toride (JP); Hiroaki Amano, Tsukuba (JP); Shinji Nishikawa, Kasumigaura (JP); Masafumi Hita, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 249 days.

(21) Appl. No.: 16/328,054

(22) PCT Filed: May 9, 2017

(86) PCT No.: PCT/JP2017/017599
§ 371 (c)(1),
(2) Date: Feb. 25, 2019

(87) PCT Pub. No.: WO2018/207267
PCT Pub. Date: Nov. 15, 2018

(65) Prior Publication Data

US 2019/0186105 A1 Jun. 20, 2019

(51) Int. Cl.
*E02F 9/22* (2006.01)
*E02F 3/32* (2006.01)
(Continued)

(52) U.S. Cl.
CPC ..... *E02F 9/2228* (2013.01); *E02F 3/32* (2013.01); *E02F 3/425* (2013.01); *E02F 3/435* (2013.01);
(Continued)

(58) Field of Classification Search
CPC ..... E02F 9/22; E02F 9/2228; E02F 9/2004; E02F 9/2267; E02F 9/2271;
(Continued)

(56) References Cited

U.S. PATENT DOCUMENTS

2008/0245065 A1 10/2008 Nakamura et al.
2008/0250782 A1 10/2008 Takeshita
(Continued)

FOREIGN PATENT DOCUMENTS

CN 1166192 A 11/1997
CN 1918377 A 2/2007
(Continued)

OTHER PUBLICATIONS

Korean-language Office Action issued in Korean Application No. 10-2019-7003182 dated Mar. 2, 2020 (five pages).
(Continued)

*Primary Examiner* — Tan Q Nguyen
(74) *Attorney, Agent, or Firm* — Crowell & Moring LLP

(57) ABSTRACT

A work machine includes directional control valves 43 and 44 each controlling a direction and a flow rate of a pressurized fluid supplied to each a boom cylinder 32 and a bucket cylinder 36; operation amount sensors 51*a*, 52*a*, and 52*b* detecting operation amounts of operation devices 51 and 52; a variable flow control valve 45 that can restrict the flow rate of the pressurized fluid in a meter-in passage of the directional control valve 44 related to the bucket cylinder 36; and a controller 60 controlling the variable flow control valve on the basis of the detection results by the operation amounts from the operation amount sensors, and the controller changes over an action mode to any one of a normal mode for restricting the flow rate of the pressurized fluid by the variable flow control valve and a responsiveness priority mode for not restricting the flow rate of the pressurized fluid by the variable flow control valve in response to the detection results of the operation amounts of the plurality of operation devices. It is thereby possible to enhance responsiveness in an action that requires responsiveness such as an action in which an operation amount of an operation lever
(Continued)

frequently changes in a short period of time and to suppress a decline in work efficiency.

6 Claims, 12 Drawing Sheets

(51) Int. Cl.
*E02F 9/20* (2006.01)
*E02F 3/42* (2006.01)
*E02F 3/43* (2006.01)
*F15B 11/16* (2006.01)

(52) U.S. Cl.
CPC ..... *E02F 9/2004* (2013.01); *E02F 9/22* (2013.01); *E02F 9/2267* (2013.01); *E02F 9/2271* (2013.01); *E02F 9/2285* (2013.01); *F15B 11/16* (2013.01); *E02F 9/2296* (2013.01); *F15B 2211/20523* (2013.01); *F15B 2211/20546* (2013.01); *F15B 2211/3116* (2013.01); *F15B 2211/327* (2013.01); *F15B 2211/329* (2013.01); *F15B 2211/351* (2013.01); *F15B 2211/353* (2013.01); *F15B 2211/41509* (2013.01); *F15B 2211/41554* (2013.01); *F15B 2211/426* (2013.01); *F15B 2211/428* (2013.01); *F15B 2211/45* (2013.01); *F15B 2211/455* (2013.01); *F15B 2211/46* (2013.01); *F15B 2211/6313* (2013.01); *F15B 2211/6316* (2013.01); *F15B 2211/6346* (2013.01); *F15B 2211/6652* (2013.01); *F15B 2211/6654* (2013.01); *F15B 2211/6658* (2013.01); *F15B 2211/7053* (2013.01); *F15B 2211/71* (2013.01); *F15B 2211/78* (2013.01)

(58) Field of Classification Search
CPC .. F15B 2211/20523; F15B 2211/20546; F15B 2211/351; F15B 2211/353
See application file for complete search history.

(56) References Cited

U.S. PATENT DOCUMENTS

| | | | | |
|---|---|---|---|---|
| 2013/0291530 | A1 | 11/2013 | Bang et al. | |
| 2014/0033689 | A1* | 2/2014 | Opdenbosch | E02F 9/2289 60/325 |
| 2017/0241445 | A1* | 8/2017 | Shang | F15B 1/04 |
| 2017/0275852 | A1 | 9/2017 | Yamashita et al. | |
| 2018/0058041 | A1* | 3/2018 | Kamoshita | E02F 9/22 |
| 2018/0216317 | A1* | 8/2018 | White | F15B 1/024 |

FOREIGN PATENT DOCUMENTS

| | | | |
|---|---|---|---|
| CN | 103299089 | A | 9/2013 |
| EP | 0 796 952 | A1 | 9/1997 |
| JP | 8-13547 | A | 1/1996 |
| JP | 8-246509 | A | 9/1996 |
| JP | 2000-129729 | A | 5/2000 |
| JP | 2004-225805 | A | 8/2004 |
| JP | 2008-261373 | A | 10/2008 |
| JP | 2013-2119 | A | 1/2013 |
| JP | 2014-119106 | A | 6/2014 |
| JP | 2016-75358 | A | 5/2016 |
| KR | 10-2017-0032390 | A | 3/2017 |
| WO | WO 2014/097693 | A | 6/2014 |
| WO | WO 2015/145946 | A1 | 10/2015 |
| WO | WO 2017/031066 | A1 | 2/2017 |

OTHER PUBLICATIONS

Chinese-language Office Action issued in Chinese Application No. 201780047627.4 dated Sep. 22, 2020 (nine (9) pages).
International Search Report (PCT/ISA/210) issued in PCT Application No. PCT/JP2017/017599 dated Jun. 20, 2017 with English translation (five (5) pages).
Japanese-language Written Opinion (PCT/ISA/237) issued in PCT Application No. PCT/JP2017/017599 dated Jun. 20, 2017 (four (4) pages).

* cited by examiner

FIG. 12

300

| | 301 WORK MODE | 302 RESPONSIVENESS PRIORITY MODE |
|---|---|---|
| 231 | EXCAVATION | VALID |
| 232 | CRANE | INVALID |
| 233 | BREAKER | INVALID |
| 234 | CUT IN-BLOCK MACHINE | INVALID |
| 235 | CRUSHING MACHINE | INVALID |
| 236 | TILT BUCKET | VALID |
| 237 | SKELETON BUCKET | VALID |

WORK MACHINE

TECHNICAL FIELD

The present invention relates to a work machine.

BACKGROUND ART

As a hydraulic circuit system in a work machine such as a hydraulic excavator, a hydraulic circuit system configured with, for example, one or more hydraulic pumps driven by a prime mover, one or more hydraulic actuators, and directional control valves each exercising control to supply and discharge a hydraulic fluid from one of the hydraulic pumps to and from each hydraulic actuator is widely used. Each directional control valve has functions as a meter-in throttle and a meter-out throttle, regulates a flow rate of the hydraulic fluid flowing from the hydraulic pump into each hydraulic actuator by the meter-in throttle, and regulates a flow rate of the hydraulic fluid discharged from each hydraulic actuator to a hydraulic fluid tank by the meter-out throttle. Examples of the hydraulic actuators in the hydraulic excavator include a boom cylinder that drives a boom, an arm cylinder that drives an arm, and a bucket cylinder that drives a bucket.

As a technique related to a work machine provided with a hydraulic circuit system configured as described above, techniques described in, for example, Patent Documents 1 and 2 are known. A work machine described in Patent Document 1 has a configuration such that a pressurized fluid is supplied from a first hydraulic pump to a bucket directional control valve and to a first boom directional control valve and a pressurized fluid is supplied from a second hydraulic pump to an arm directional control valve and to a second boom directional control valve, and is configured such that a boom at a high load pressure and the other hydraulic actuator (such as an arm or a bucket) can be simultaneously moved by causing auxiliary flow control means that restricts a supply flow rate of the pressurized fluid to the bucket directional control valve to reduce the supply flow rate of the pressurized fluid to the bucket directional control valve in proportion to an increase in a boom raising operation amount. Furthermore, a work machine described in Patent Document 2 is configured with a solenoid proportional valve that can reduce a pilot pressure for driving a directional control valve, and is configured such that driving the solenoid proportional valve to reduce an opening area of a meter-out throttle of the directional control valve in proportion to an increase in a cylinder pressure makes it possible to suppress a cylinder speed and to prevent cavitation.

PRIOR ART DOCUMENT

Patent Documents

Patent Document 1: JP-1996-13547-A
Patent Document 2: JP-2016-75358-A

SUMMARY OF THE INVENTION

Problem to be Solved by the Invention

Meanwhile, the development of a work machine exercising control to make a delivery flow rate of a hydraulic pump lower than before for enhancing fuel efficiency has been recently underway and it is conceivable that the conventional technique described above is applied to such a work machine.

However, in a case of exercising control to make the delivery flow rate of the hydraulic pump lower for enhancing the fuel efficiency, the conventional techniques have the following problems. In other words, no problem occurs in a case of an action by a hydraulic actuator at a relatively low driving speed. However, in a case of repeatedly performing an action of tilting an operation lever in a bucket dumping direction and an action of returning the operation lever such as a gravel spreading action, that is, in a case in which an operation amount of the operation lever frequently changes in a short period of time, the responsiveness of the hydraulic actuator deteriorates because of the control to reduce the opening area of the directional control valve by functions of the auxiliary flow control means and the solenoid proportional valve. In addition, the bucket slows down by as much as this response delay to make it impossible to appropriately spread gravel, and work accuracy and work efficiency are possibly greatly declined.

The present invention has been achieved in the light of the above problems, and an object of the present invention is to provide a work machine that can enhance responsiveness in an action that requires responsiveness such as an action in which an operation amount of an operation lever frequently changes in a short period of time and that can suppress declines in work accuracy and work efficiency.

Means for Solving the Problem

While the present application includes a plurality of means for solving the problems. As an example, there is provided a work machine including: a hydraulic pump driven by a prime mover; a multijoint type front work implement configured such that a plurality of driven members including at least a boom, an arm, and a work tool are coupled rotatably; a plurality of hydraulic actuators each driven by a pressurized fluid delivered from the hydraulic pump and driving each of the plurality of driven members; a plurality of directional control valves each controlling a direction and a flow rate of the pressurized fluid supplied from the hydraulic pump to each of the plurality of hydraulic actuators; a plurality of operation devices controlling the plurality of directional control valves; a plurality of operation amount sensors detecting operation amounts of the operation devices related to at least the boom and the work tool among the plurality of operation devices; a flow restriction device that can restrict a flow rate of the pressurized fluid in at least one of a meter-in passage and a meter-out passage of one of the directional control valves, the one directional control valve being related to the work tool; and a controller controlling the flow restriction device on the basis of detection results of operation amounts from the plurality of operation amount sensors, the controller being configured to be capable of changing over an action mode to any one of a normal mode for restricting the flow rate of the pressurized fluid by the flow restriction device and a responsiveness priority mode for not restricting the flow rate of the pressurized fluid by the flow restriction device in response to the detection results of the operation amounts of the plurality of operation devices.

Advantages of the Invention

According to the present invention, it is possible to enhance responsiveness in an action that requires responsiveness such as an action in which an operation amount of an operation lever frequently changes in a short period of time and to suppress a decline in work efficiency.

BRIEF DESCRIPTION OF THE DRAWINGS

FIG. 12 is a view depicting an example of a valid/invalid determination table for determining a changeover to the responsiveness priority mode is possible for every work mode.

MODES FOR CARRYING OUT THE INVENTION

Embodiments of the present invention will be described hereinafter with reference to the drawings. While a hydraulic excavator configured with a bucket on a tip end of a front device (front work implement) as a work tool will be described as an example of a work machine in present embodiments, the present invention can be applied to a hydraulic excavator configured with an attachment other than the bucket.

Embodiment 1

Embodiment 1 of the present invention will be described with reference to FIGS. 1 to 5.

Figure 1:
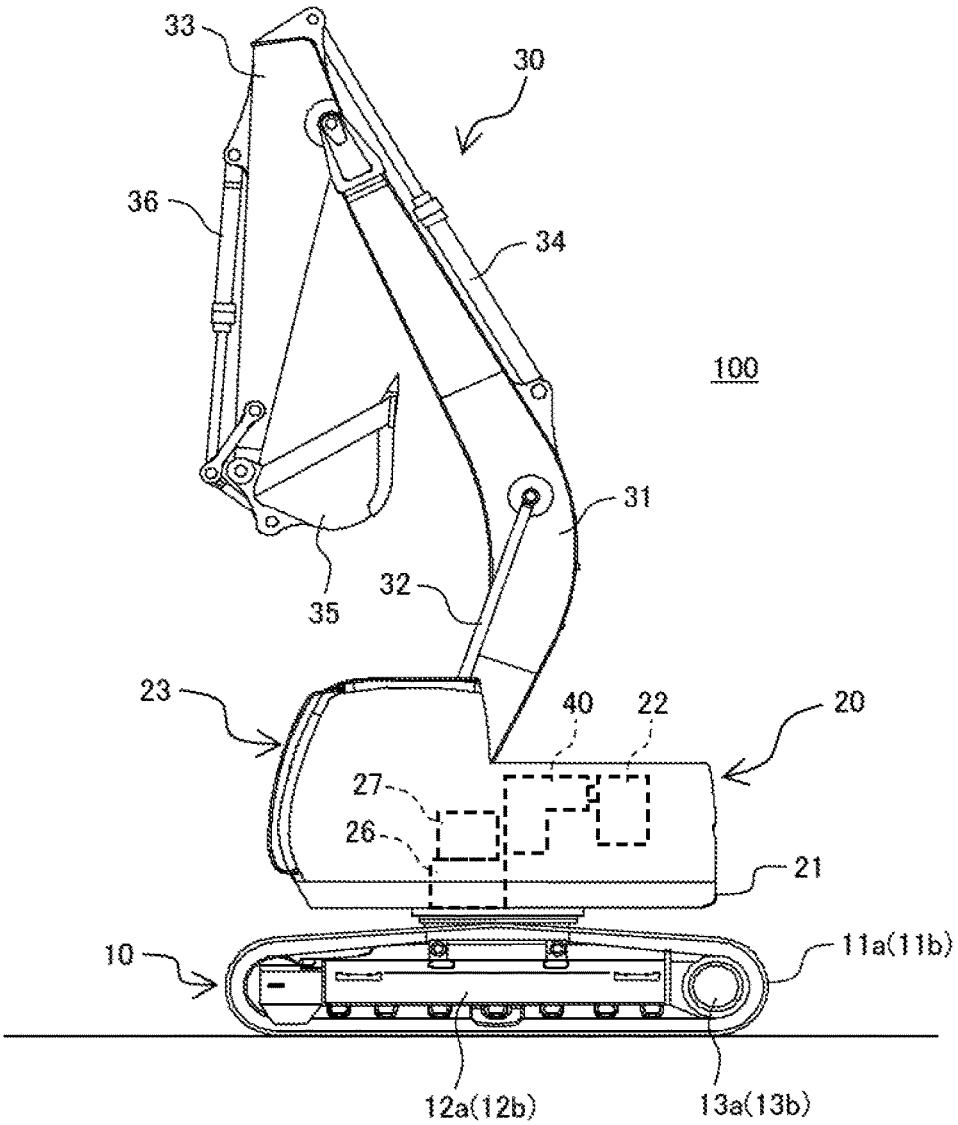
FIG. 1 is a side view schematically depicting an outward appearance of a hydraulic excavator that is an example of a work machine according to Embodiment 1.

FIG. 1 is a side view schematically depicting an outward appearance of a hydraulic excavator that is an example of a work machine according to Embodiment 1.

In FIG. 1, a hydraulic excavator 100 is configured with a multijoint type front device (front work implement) 30 configured by coupling a plurality of driven members (a boom 31, an arm 33, and a bucket (work tool) 35) that rotate in a perpendicular direction, and an upper swing structure 20 and a lower travel structure 10 that configure a machine body, and the upper swing structure 20 is provided swingably about the lower travel structure 10. The upper swing structure 20 is configured such that members are disposed on a swing frame 21 that serves as a base portion, and the swing frame 21 that configures the upper swing structure 20 is swingable about the lower travel structure 10. Furthermore, a base end of the boom 31 of the front device 30 is supported by a front portion of the upper swing structure 20 in such a manner as to be rotatable in the perpendicular direction, one end of the arm 33 is supported by an end portion (tip end) other than the base end of the boom 31 in such a manner as to be rotatable in the perpendicular direction, and the bucket 35 is supported by the other end of the arm 33 in such a manner as to be rotatable in the perpendicular direction.

The lower travel structure 10 is configured with a pair of crawlers 11*a* (11*b*) looped over a pair of left and right crawler frames 12*a* (12*b*), respectively, and track hydraulic motors 13*a* (13*b*) driving the crawlers 11*a* (11*b*), respectively. As for configurations of the lower travel structure 10, only one of each pair of left and right configurations is depicted and denoted by a reference character while the other configuration is denoted only by a reference character in parentheses and not depicted.

The boom 31, the arm 33, and the bucket 35 are driven by a boom cylinder 32, an arm cylinder 34, and a bucket cylinder 36 that are hydraulic actuators, respectively, and the lower travel structure 10 is driven by the left and right track hydraulic motors 13*a* (13*b*) that are hydraulic actuators. Furthermore, the upper swing structure 20 is similarly driven by a swing hydraulic motor 27 that is a hydraulic actuator via a speed reduction mechanism 26 and performs a swing action with respect to the lower travel structure 10.

An engine 22 that is a prime mover and a hydraulic circuit system 40 for driving the hydraulic actuators 13*a* (13*b*), 27, 32, 34, and 36 such as the boom cylinder 32, the arm cylinder 34, the bucket cylinder 36, the swing hydraulic motor 27, and the left and right track hydraulic motors 13*a* (13*b*) are mounted on the swing frame 21 that configures the upper swing structure 20.

Figure 2:
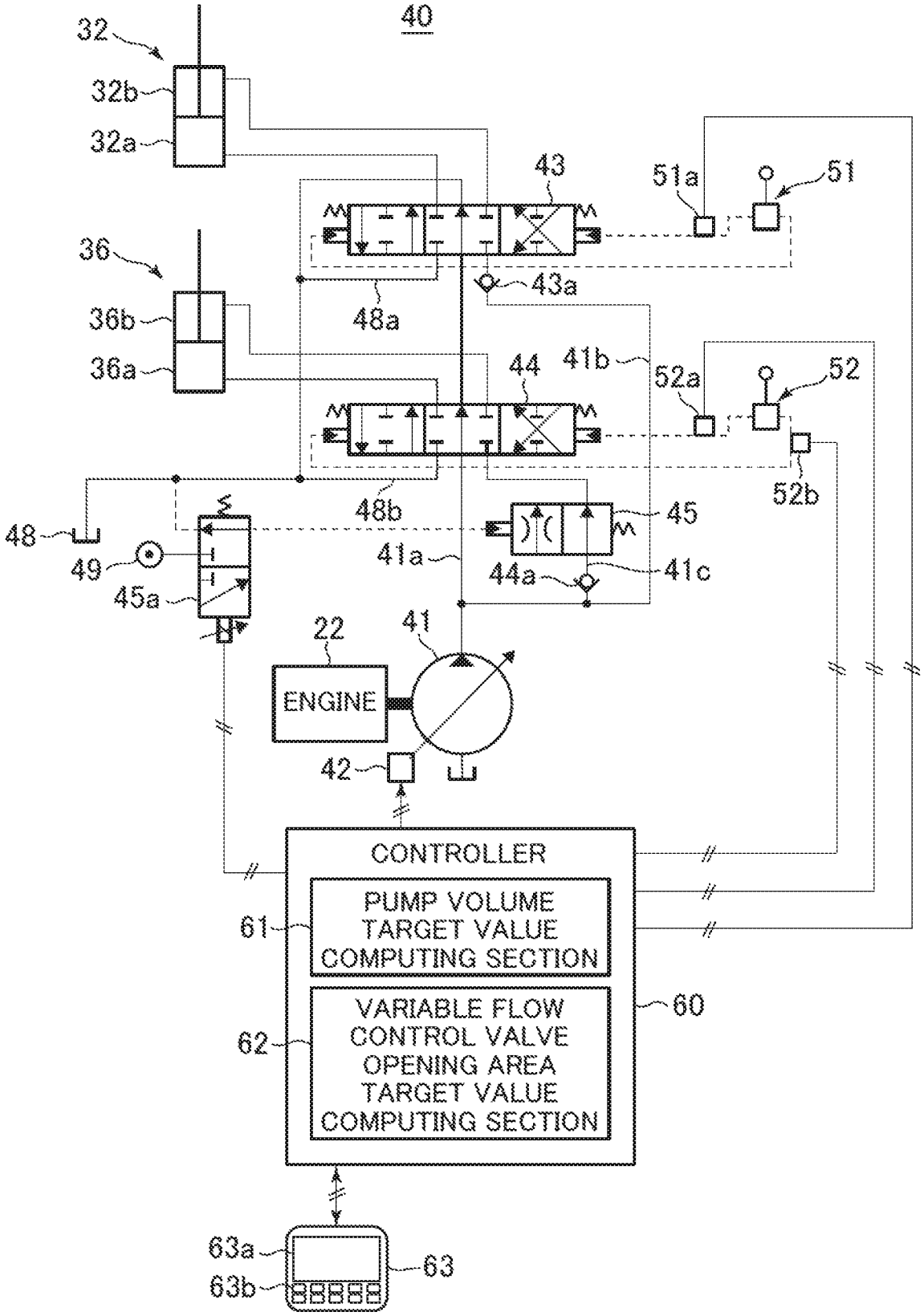
FIG. 2 is a schematic diagram depicting extracted principal parts of a hydraulic circuit system according to Embodiment 1.

FIG. 2 is a schematic diagram depicting extracted principal parts of the hydraulic circuit system according to Embodiment 1.

In FIG. 2, the hydraulic circuit system 40 is configured with a variable displacement hydraulic pump 41 and a fixed displacement pilot pump (pilot hydraulic fluid source) 49 driven by the engine 22, a regulator 42 controlling a pump volume (tilting angle) of the hydraulic pump 41 on the basis of a control signal from a controller 60 that controls entire actions of the hydraulic excavator 100, directional control valves (spools) 43 and 44 controlling directions and flow rates of a hydraulic fluid supplied from the hydraulic pump 41 to the hydraulic actuators 32 and 36 on the basis of pilot pressures (operation signals) introduced from operation lever devices 51 and 52 via pilot hydraulic lines, a solenoid proportional valve 45*a* converting the control signal output from the controller 60 as an electrical signal into a control signal, which is a pilot pressure, and outputting the control signal to a variable flow control valve (variable throttle) 45, and the variable flow control valve (flow restriction device) 45 that can restrict the flow rate of the pressurized fluid (hydraulic fluid) in a meter-in passage of the directional control valve 44 related to the bucket cylinder 36 on the basis of the control signal transmitted from the controller 60 through the solenoid proportional valve 45*a*. The variable flow control valve 45 is disposed in a supply hydraulic line 41*c* between the meter-in passage of the directional control valve 44 related to the bucket cylinder 36 that drives the bucket 35 and the hydraulic pump 41 (that is, a hydraulic pump 41-side of the directional control valve 44). It is noted that only the boom cylinder 32 and the bucket cylinder 36 among a plurality of hydraulic actuators and configurations associated with the boom cylinder 32 and the bucket cylinder 36 are extracted and depicted in FIG. 2, and that the other hydraulic actuators and configurations associated with the other hydraulic actuators are not depicted for the brevity of description.

The directional control valves 43 and 44 are connected in series while commonly using a center bypass hydraulic line 41*a* that returns the pressurized fluid delivered from the hydraulic pump 41 to a hydraulic fluid tank 48, and connected in parallel by supply hydraulic lines 41*b* and 41*c* that supply the pressurized fluid delivered from the hydraulic pump 41 to the hydraulic actuators 32 and 36, respectively. In other words, the pressurized fluid delivered from the hydraulic pump 41 is introduced by the center bypass hydraulic line 41*a* to the directional control valve 43 related to the bucket cylinder 36 and the directional control valve 44 related to the boom cylinder 32 in this order, and returned to the hydraulic fluid tank 48. Furthermore, the pressurized fluid delivered from the hydraulic pump 41 is supplied to the hydraulic actuator 32 via the supply hydraulic line 41*b* and then a meter-in passage of the directional control valve 43 and supplied to the hydraulic actuator 34 via the supply hydraulic line 41*c* connected in parallel to the supply hydraulic line 41*b* and then the meter-in passage of the directional control valve 44.

Check valves 43*a* and 44*a* are provided in the supply hydraulic line 41*b* (that is, upstream of the directional control valve 43) and upstream of the variable flow control valve 45 (also upstream of the directional control valve 44) in the supply hydraulic line 41*b*, respectively. The check valves 43*a* and 44*a* permit supply of the pressurized fluid to the hydraulic actuators 32 and 36 only in a case in which a delivery pressure (pump pressure) of the hydraulic pump 41 is higher than pressures (actuator pressures) of the hydraulic actuators 32 and 36, and interrupt conduction of the pressurized fluid from the hydraulic actuators 32 and 36 to the hydraulic pump 41 in a case in which the pump pressure is lower than the actuator pressures.

The solenoid proportional valve 45*a* generates the pilot pressure operating the variable flow control valve 45 on the basis of the control signal output from the controller 60 as the electrical signal, and it may be said that the solenoid proportional valve 45*a* converts the control signal (electrical signal) output from the controller 60 into the control signal (pilot pressure). A position of the solenoid proportional valve 45*a* is changed over to a position depicted in FIG. 2 in a case in which the control signal is not input to the solenoid proportional valve 45*a* from the controller 60, and the control signal (pilot pressure) to be output to the variable flow control valve 45 is kept at a tank pressure. Furthermore, in a case in which the control signal is input to the solenoid proportional valve 45*a* from the controller 60, the solenoid proportional valve 45*a* moves in an upward direction in FIG. 2 in response to an increase in the control signal and the control signal (pilot pressure) to act on the variable flow control valve 45 increases. It is noted that a relationship among the control signal (electrical signal) output from the controller 60, the control signal (pilot pressure) generated by the solenoid proportional valve 45*a*, and an opening area of the variable flow control valve 45 is calculated in advance, and stored in the controller 60 in the form of a table or the like.

The variable flow control valve 45 is the flow regulation device that regulates the flow rate of the pressurized fluid flowing from the hydraulic pump 41 to the directional control valve 44 by changing the opening area of the variable flow control valve 45 on the basis of the control signal input from the controller 60 via the solenoid proportional valve 45*a*. The variable flow control valve 45 is kept at a position (at which the opening area is a maximum) depicted in FIG. 2 when the control signal (pilot pressure) from the solenoid proportional valve 45*a* is equal to the tank pressure, and moves in a rightward direction in FIG. 2 in response to the increase in the control signal to reduce the opening area.

The variable flow control valve 45 has functions of reducing the opening area and restricting the flow rate of the pressurized fluid flowing to the bucket cylinder 36 at a time of simultaneously operating boom raising and bucket crowding or boom raising and bucket dumping, thereby making it possible to maintain high the delivery pressure of the hydraulic pump 41 and to perform simultaneous actions of the bucket 36 and the boom 31 even in a case of operating the bucket 35 in midair. Unless the variable flow control valve 45 is configured such that the opening area thereof can be reduced (that is, the opening area thereof can be restricted) in operating the bucket 35 in midair with a load of the bucket 35 (that is, the bucket cylinder 36) being light, the pressurized fluid delivered from the hydraulic pump 41 is prone to flow to the bucket cylinder 36 at the light load. As a result, the delivery pressure of the hydraulic pump 41 does not rise and the boom 31 (that is, the boom cylinder 32) at a heavy load is difficult to move. While FIG. 2 exemplarily depicts the configuration such that the variable flow control valve 45 is driven by the pilot pressure generated by the solenoid proportional valve 45*a* on the basis of the control signal from the controller 60, a solenoid valve, for example, electrically driven by the control signal from the controller 60 may be conceivable.

A cabin 23 (cabinet: refer to FIG. 1) in which an operator is on board is provided with the plurality of operation lever devices (operation devices) 51 and 52 that output operation signals for operating the hydraulic actuators 27, 32, 34, and 36. The directional control valves 43 and 44 are driven by the operation signals (pilot pressures) output from the operation lever devices 51 and 52 on the basis of the delivery pressure of the pressurized fluid supplied from the pilot pump 49 via a line that is not depicted. The operation lever devices 51 and 52 can be tilted front and back and left and right, and include operation amount sensors 51*a*, 52*a*, and 52*b* each configured by a pressure sensor that detects a lever operation amount (that is, the pilot pressure corresponding to the lever operation amount) when operating boom raising, operating bucket dumping, or operating bucket crowding and that outputs the lever operation amount to the controller 60 via a signal line. The directional control valves 43 and 44 related to the boom cylinder 32 and the bucket cylinder 36 and directional control valves, not depicted, related to the arm cylinder 34 and the swing hydraulic motor 27 are controlled by the pilot pressures (operation signals) in response to operation directions and operation amounts of the operation lever devices 51 and 52 operated by the operator, thereby controlling actions of the hydraulic actuators 27, 32, 34, and 36. In other words, any of operating the hydraulic actuator 27, operating the hydraulic actuator 32, operating the hydraulic actuator 34, and operating the hydraulic actuator 36 is allocated to front and back directions or left and right directions of the operation lever devices 51 and 52.

Operating the boom 31 is allocated to the front and back directions (or left and right directions) of the operation lever device 51. In a case in which the operation lever device 51 operates boom raising, then the directional control valve 43 is driven to a left side in FIG. 2 in response to an operation amount of a boom raising operation, the pressurized fluid delivered from the hydraulic pump 41 is supplied to a bottom chamber (boom cylinder bottom chamber) 32*a* of the boom cylinder 32 via the supply hydraulic line 41*b* and the meter-in passage of the directional control valve 43, and the pressurized fluid in a rod chamber (boom cylinder rod chamber) 32*b* of the boom cylinder 32 flows into the hydraulic fluid tank 48 via a meter-out passage of the directional control valve 43 and a return hydraulic line 48*a*, whereby the boom cylinder 32 extends to perform a boom raising action. Likewise, in a case in which the operation lever device 51 operates boom lowering, then the directional control valve 43 is driven to a right side in FIG. 2 in response to an operation amount of a boom lowering operation, the pressurized fluid delivered from the hydraulic pump 41 is supplied to the boom cylinder rod chamber 32*b* via the supply hydraulic line 41*b* and the meter-in passage of the directional control valve 43, and the pressurized fluid in the boom cylinder bottom chamber 32*a* flows into the hydraulic fluid tank 48 via the meter-out passage of the directional control valve 43 and the return hydraulic line 48*a*, whereby the boom cylinder 32 contracts to perform a boom lowering action.

Moreover, operating the bucket 35 is allocated to the front and back directions (or left and right directions) of the operation lever device 52. In a case in which the operation lever device 52 operates bucket crowding, then the directional control valve 44 is driven to a left side in FIG. 2 in response to an operation amount of a bucket crowding operation, the pressurized fluid delivered from the hydraulic pump 41 is supplied to a bottom chamber (bucket cylinder bottom chamber) 36*a* of the bucket cylinder 36 via the variable flow control valve 45 in the supply hydraulic line 41*c* and the meter-in passage of the directional control valve 44, and the pressurized fluid in a rod chamber (bucket cylinder rod chamber) 36*b* of the bucket cylinder 36 flows into the hydraulic fluid tank 48 via a meter-out passage of the directional control valve 44 and a return hydraulic line 48*b*, whereby the bucket cylinder 36 extends to perform a bucket crowding action. Likewise, in a case in which the operation lever device 52 operates bucket dumping, then the directional control valve 44 is driven to a right side in FIG. 2 in response to an operation amount of a bucket dumping operation, the pressurized fluid delivered from the hydraulic pump 41 is supplied to the bucket cylinder rod chamber 36*b* via the variable flow control valve 45 in the supply hydraulic line 41*c* and the meter-in passage of the directional control valve 44, and the pressurized fluid in the bucket cylinder bottom chamber 36*a* flows into the hydraulic fluid tank 48 via the meter-out passage of the directional control valve 44 and the return hydraulic line 48*b*, whereby the bucket cylinder 36 contracts to perform a bucket dumping action.

While a case in which the operation lever devices 51 and 52 are different operation lever devices has been exemplarily described, the bucket 35 and the boom 31 can be similarly operated in a case, for example, in which operating the bucket 35 is allocated to front and back directions (or left and right directions) of one operation lever device and operating the boom 31 is allocated to the left and right directions (or front and back directions) thereof.

Moreover, the operation lever devices 51 and 52 may be electrical signal type operation lever devices, and the hydraulic circuit system 40 may be configured such that lever tilting amounts (that is, lever operation amounts) corresponding to the operation signals introduced from the operation lever devices 51 and 52 operated by the operator via pilot hydraulic lines are electrically output to the controller 60, and the controller 60 controls a solenoid proportional valve or the like on the basis of detected lever operation amounts, thereby controlling the pilot pressures driving the hydraulic actuators 27, 32, 34, and 36.

The controller 60 controls the entire actions of the hydraulic excavator 100, and is configured with a pump volume target value computing section 61 that computes the control signal to be output to the regulator 42 on the basis of detection results from the operation amount sensors 51*a*, 52*a*, and 52*b* (which are detection values of the pilot pressures (operation signals) in the pilot hydraulic lines related to the operation lever devices 51 and 52 and which correspond to the operation amounts of the operation lever devices 51 and 52), thereby controlling the pump volume of the hydraulic pump 41 and controlling the delivery flow rate thereof, and a variable flow control valve opening area target value computing section 62 that computes the control signal to be output to the variable flow control valve 45 disposed in the supply hydraulic line 41*c* between the meter-in passage of the bucket cylinder 36 and the hydraulic pump 41 (that is, the control signal generated by the solenoid proportional valve 45*a*) on the basis of the detection results from the operation amount sensors 51*a*, 52*a*, and 52*b*, thereby controlling the opening area of the variable flow control valve 45. Furthermore, an input/output device 63, which is disposed in the cabinet 23 and in which a monitor (display device) 63*a* for displaying various information about the hydraulic excavator 100, setting screens, and the like, and an operation switch group 63*b* operating the various setting screens displayed on the monitor 63*a* are disposed, is connected to the controller 60. It is noted that since it is enough for the operation switch group 63*b* to operate contents displayed on the monitor 63*a*, a configuration of the operation switch group 63*b* such that selection and determination are made by rotating and depressing a rotary switch may be adopted.

Figure 3:
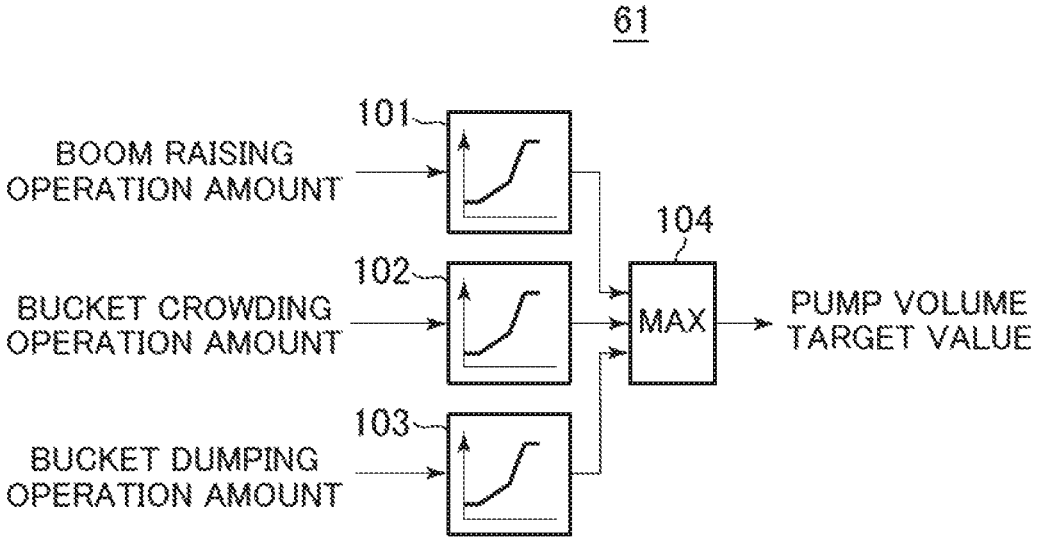
FIG. 3 is a functional block diagram depicting process contents of a pump volume target value computing section.

FIG. 3 is a functional block diagram depicting process contents of the pump volume target value computing section.

In FIG. 3, the pump volume target value computing section 61 is configured with a computing section 101 that calculates one of candidate values of a pump volume target value on the basis of the operation amount of the boom raising operation (boom raising operation amount) of the operation lever device 51 and a preset table, a computing section 102 that calculates one of the candidate values of the pump volume target value on the basis of the operation amount of the bucket crowding operation (bucket crowding operation amount) of the operation lever device 52 and a preset table, a computing section 103 that calculates one of the candidate values of the pump volume target value on the basis of the operation amount of the bucket dumping operation (bucket dumping operation amount) of the operation lever device 52 and a preset table, and a maximum value selection section 104 that selects a maximum value among computation results of the computing sections 101 to 103 and that outputs the selected maximum value as a computation result of the pump volume target value computing section 61 (pump volume target value). In FIG. 3, graph-like tables each with a horizontal axis representing an input value (operation amount of the operation lever device 51 or 52) and a vertical axis representing the candidate value of the pump volume target value are exemplarily depicted as the tables preset to the computing sections 101 to 103, and each table is set such that the candidate value of the pump volume target value increases in proportion to an increase in the operation amount of the operation lever device 51 or 52.

It is noted that either the same numeric values or different numeric values may be set to the tables preset to the computing sections 101 to 103 in FIG. 3. Furthermore, the pump volume target value computing section 61 may be also configured with other computing sections to which operation amounts of operating the driven members other than the boom and the bucket are input, and may be configured to determine the pump volume target value in the light of not only the computation results described above but also computation results of the other computing sections.

Figure 4:
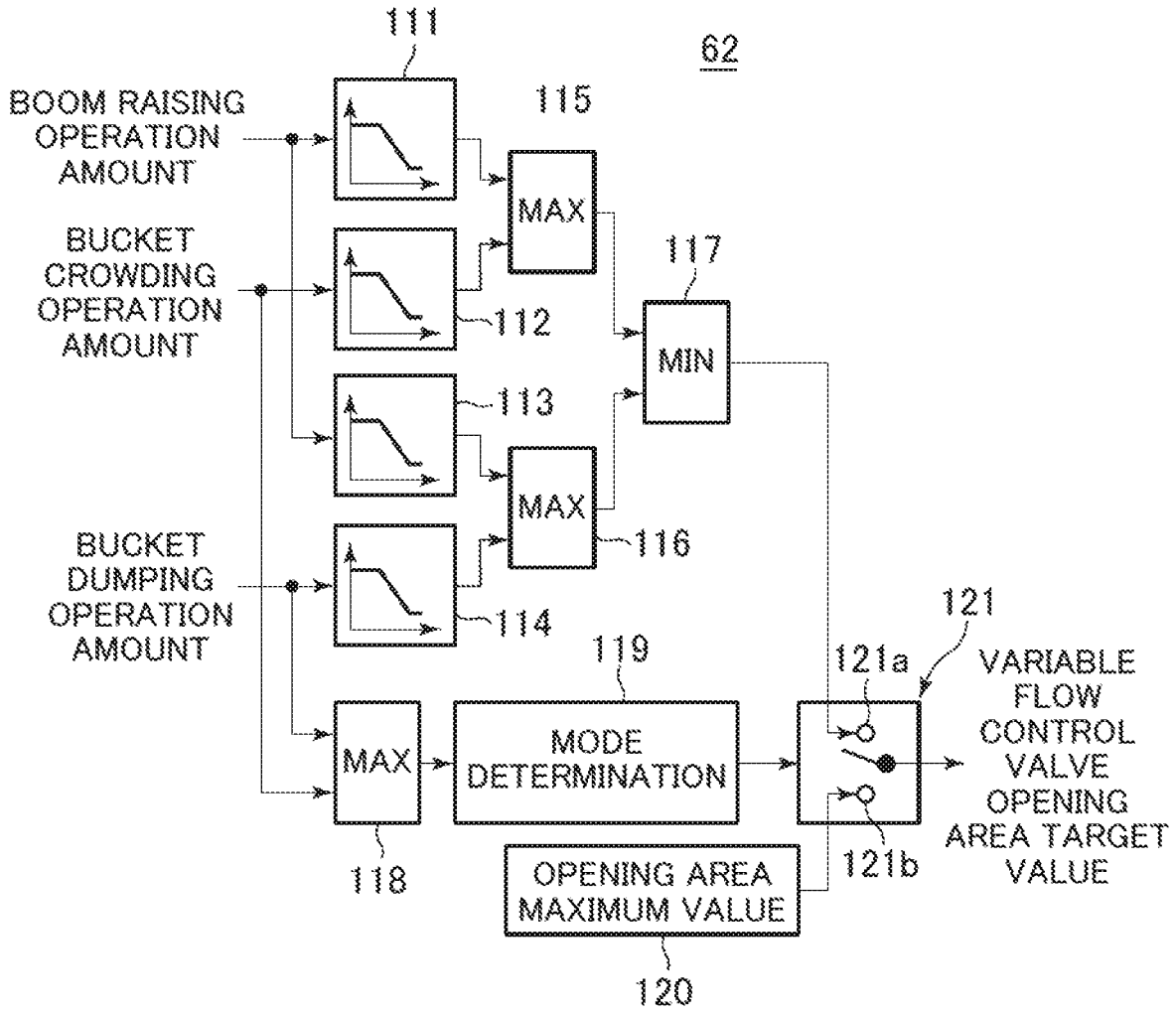
FIG. 4 is a functional block diagram depicting process contents of a variable flow control valve opening area target value computing section according to Embodiment 1.

FIG. 4 is a functional block diagram depicting process contents of the variable flow control valve opening area target value computing section.

In FIG. 4, the variable flow control valve opening area target value computing section 62 is configured with a computing section 111 that calculates one of candidate values of a variable flow control valve opening area target value on the basis of the boom raising operation amount and a preset table, a computing section 112 that calculates one of the candidate values of the variable flow control valve opening area target value on the basis of the bucket crowding operation amount and a preset table, a maximum value selection section 115 that selects a maximum value out of computation results of the computing sections 111 and 112, a computing section 113 that calculates one of the candidate values of the variable flow control valve opening area target value on the basis of the boom raising operation amount and a preset table, a computing section 114 that calculates one of the candidate values of the variable flow control valve opening area target value on the basis of the bucket dumping operation amount and a preset table, a maximum value selection section 116 that selects a maximum value out of computation results of the computing sections 113 and 114, a minimum value selection section 117 that selects a minimum value out of the computation results selected by the maximum value selection sections 115 and 116, a maximum value selection section 118 that selects a maximum value out of the bucket crowding operation amount and the bucket dumping operation amount, an opening area maximum value 120 that is set as one of the candidate values of the variable flow control valve opening area target value, a mode determination section 119 that determines whether an action mode suited for an action of the front device 30 is "normal mode" or "responsiveness priority mode," to be described later, on the basis of a selection result of the maximum value selection section 118, and an output value changeover section 121 that changes over an output value in such a manner as to output any one of a selection result of the minimum value selection section 117 (input 121*a* side) and the opening area maximum value 120 (input 121*b* side) as a computation result of the variable flow control valve opening area target value computing section 62 (variable flow control valve opening area target value) on the basis of a determination result of the mode determination section 119.

It is noted that in FIG. 4, graph-like tables each with a horizontal axis representing an input value (operation amount of the operation lever device 51 or 52) and a vertical axis representing the candidate value of the variable flow control valve opening area target value are exemplarily depicted as the tables preset to the computing sections 111 to 114, and each table is set such that the candidate value of the variable flow control valve opening area target value decreases in proportion to the increase in the operation amount of the operation lever device 51 or 52.

The output value changeover section 121 outputs the selection result of the minimum value selection section 117 (input 121*a* side) as the computation result of the variable flow control valve opening area target value computing section (variable flow control valve opening area target value) in a case in which the determination result of the mode determination section 119 is "normal mode," and outputs the opening area maximum value 120 (input 121*b* side) as the variable flow control valve opening area target value in a case in which the determination result is "responsiveness priority mode."

It is to be noted herein that the normal mode out of the action modes determined by a mode determination process is an action mode set when, for example, boom raising and bucket crowding or boom raising and bucket dumping are simultaneously operated. When the normal mode is set in Embodiment 1, the opening area of the variable flow control valve 45 is reduced and the flow rate of the pressurized fluid flowing to the bucket cylinder 36 is restricted, thereby making it possible to maintain high the delivery pressure of the hydraulic pump 41 and perform the simultaneous actions of the bucket 35 and the boom 31 even in the case of operating the bucket 35 in midair. In addition, the responsiveness priority mode out of the action modes determined by the mode determination process is an action mode set in an action that requires responsiveness such as in a case of repeating an action of tilting the operation lever device 52 in a bucket dumping direction and an action of returning the operation lever device 52 in a short period of time, for example, a gravel spreading action using a bucket for excavation, and in a case of repeating actions of tilting the operation lever device 52 in the bucket dumping direction and a bucket crowding direction and an action of returning the operation lever device 52 in a short period of time, for example, a screening action using a skeleton bucket (not depicted) having mesh holes on a bottom surface, that is, in a case in which the operation amount of the operation lever device 52 changes intermittently and frequently in a short period of time. When the responsiveness priority mode is set in Embodiment 1, the opening area of the variable flow control valve 45 is increased to enhance the responsiveness.

Figure 5:
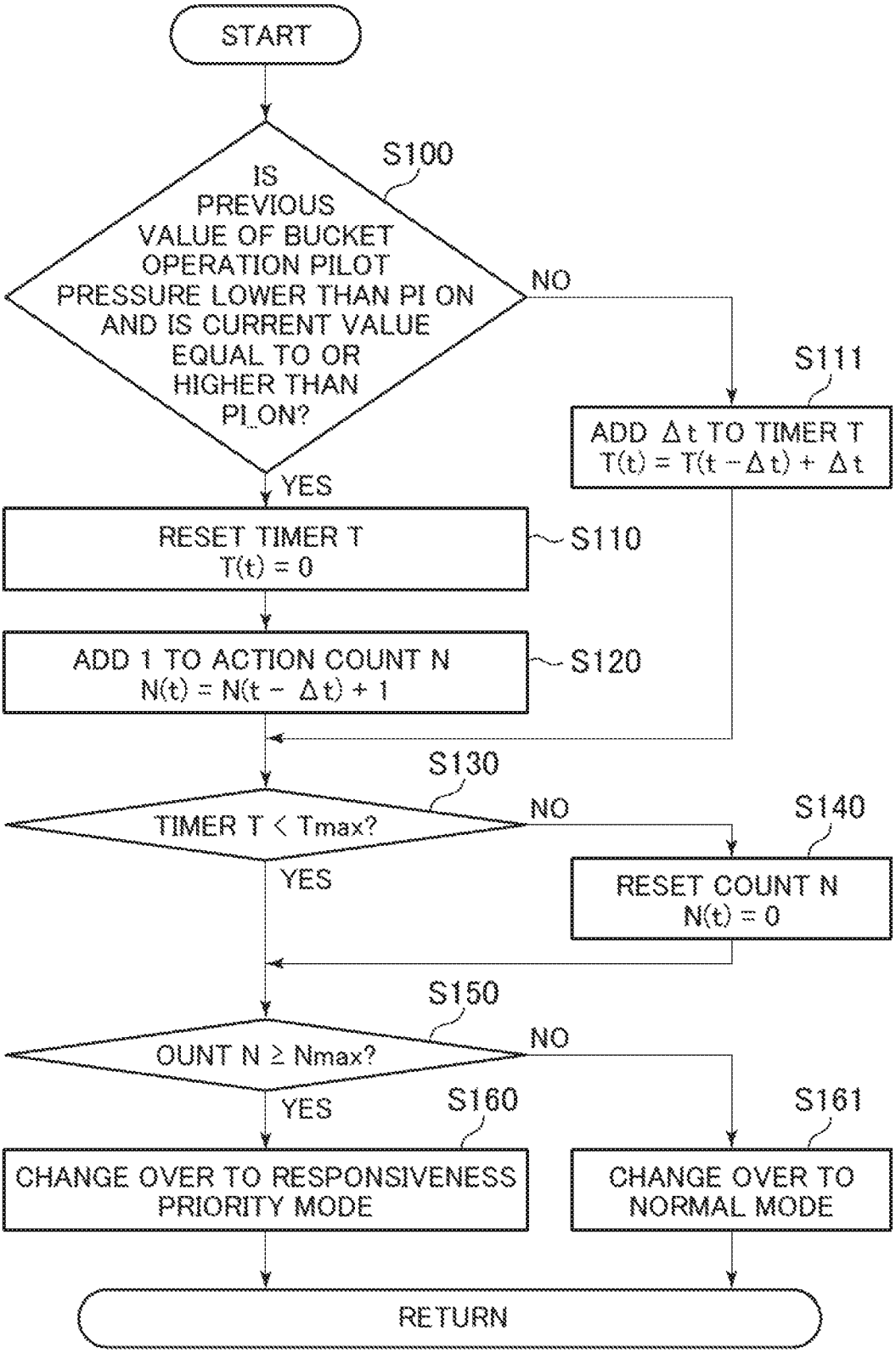
FIG. 5 is a flowchart illustrating process contents of a mode determination process performed by a mode determination section of a controller.

FIG. 5 is flowchart illustrating process contents of the mode determination process performed by the mode determination section of the controller.

In FIG. 5, the mode determination section 119 repeatedly executes the mode determination process (Steps S100 to S161) at intervals of time Δt. In other words, the time Δt is a cycle for repeatedly executing the mode determination process, which is a sampling cycle in which the variable flow control valve opening area target value computing section 62 imports the detection results from the operation amount sensors 51*a*, 52*a*, and 52*b*, and unit time (for example, 10 ms) of internal computation by controller 60 is, for example, used as the time Δt.

First, the mode determination section 119 determines whether a detection value of a pilot pressure corresponding to a packet operation at a time (assumed as time t−Δt) of executing a previous mode determination process, that is, a previous detection result (previous value) of the operation amount sensors 52*a* and 52*b* is lower than a threshold PI_ON and whether a detection result (current value) at current time (assumed as time t) is equal to or higher than the threshold PI_ON (Step S100). The threshold PI_ON is a reference for determining whether the operation lever device 52 has operated the bucket 35 (has operated bucket crowding or bucket dumping). The mode determination section 119 determines that the operation lever device 52 has not operated the bucket 35 (the operation lever device 52 is at a neutral position) in a case in which the detection result of the operation amount sensors 52*a* and 52*b* is lower than the threshold PI_ON, and determines that the operation lever device 52 has operated the bucket 35 in a case in which the detection result is lower than the threshold PI_ON. It is noted that the mode determination section 119 performs determination in Step S100 assuming that the previous value is lower than the threshold PI_ON in a case in which the previous value is not present for a reason such as a reason that a process of Step S100 is a first process in the mode determination process.

In a case in which a determination result of Step S100 is YES, that is, the operation lever device 52 has operated the bucket 35 during the time Δt, then the mode determination section 119 resets a timer T that is a variable for time counting as T(t)=0 (Step S110), and adds 1 to a count N that is a variable for counting the number of times of operating the bucket 35 by the operation lever device 52 (number of actions) (Step S120). Furthermore, in a case in which the determination result of Step S100 is NO, that is, the operation lever device 52 has not operated the bucket 35 during the time Δt, the mode determination section 119 adds the time Δt to the timer T (Step S111).

Next, the mode determination section 119 determines whether the timer T is shorter than preset reference time Tmax (for example, 0.5 second) (Step S130). In the case in which the determination result of Step S100 is NO (that is, in the case in which the operation lever device 52 has not operated the bucket 35 during the reference time Tmax), the mode determination section 119 resets the count N as N(t)=0 (Step S140).

Next, in a case in which a determination result of Step S130 is YES or in a case in which a process in Step S140 is over, the mode determination section 119 determines whether the count N is equal to or higher than a preset reference number Nmax (for example, 2) (Step S150). In a case in which the determination result of Step 150 is YES, that is, in a case in which the number of times of operating the bucket 35 by the operation lever device 52 within fixed time (which is the reference time Tmax) is equal to or higher than a fixed number (which is the reference number Nmax), the mode determination section 119 changes over the action mode to the responsiveness priority mode (Step S160), and repeats the mode determination process (Steps 5100 to S161). In a case in which the determination result of Step S150 is NO, the mode determination section 119 changes over the action mode to the normal mode (Step S161), and repeats the mode determination process (Steps 5100 to S161).

Actions of Embodiment 1 configured as described above will be described.

In a case in which the work machine 100 according to Embodiment 1 performs work in which the operation amount of the operation lever device 52 changes intermittently and frequently in a short period of time, that is, in a case of repeating the action of tilting the operation lever device 52 in the bucket dumping direction (or bucket crowding direction) and the action of returning the operation lever device 52 in a short period of time, for example, the gravel spreading action or the screening action, the responsiveness priority mode is set in the mode determination process. In a case in which the responsiveness priority mode is set, the variable flow control valve opening area target value computing section 62 sets large the opening area target value of the variable flow control valve 45 (for example, sets the opening area target value to an opening area maximum value at which the flow rate of the pressurized fluid is not restricted by the variable flow control valve 45) regardless of the boom raising operation. It is thereby possible to enhance packet operation responsiveness in the action of changing the operation amount of the operation lever device 52 intermittently and frequently.

Furthermore, in a case of performing a normal operation other than the operation in which the responsiveness priority mode is set, the normal mode is set in the mode determination process. In a case in which the normal mode is set, the variable flow control valve opening area target value computing section 62 sets small the opening area target value of the variable flow control valve 45 in response to the operation amounts of the operation lever devices 51 and 52 to restrict the flow rate of the pressurized fluid flowing to the bucket cylinder 36. It is thereby possible to maintain high the delivery pressure of the hydraulic pump 41 and to appropriately perform the simultaneous actions of the bucket 36 and the boom 31 even in the case of operating the bucket 35 in midair at the time of simultaneously operating the boom raising and the bucket crowding or the boom raising and the bucket dumping.

Advantages of the present embodiment configured as described so far will be described.

There is the work machine according to the conventional technique that is configured such that the boom at the high load pressure and the bucket or the like at the low load pressure can be simultaneously moved by causing the auxiliary flow control means that restricts the supply flow rate of the pressurized fluid to the bucket directional control valve to reduce the supply flow rate of the pressurized fluid to the bucket directional control valve. Furthermore, there is the work machine that is configured with the solenoid proportional valve that can reduce the pilot pressure for driving the directional control valve and that is configured such that driving the solenoid proportional valve to reduce the opening area of the meter-out throttle of the directional control valve in proportion to the increase in the cylinder pressure makes it possible to suppress the cylinder speed and to prevent cavitation.

No problem occurs to a relatively slow action in a case of exercising control to reduce the delivery flow rate of the hydraulic pump for enhancing fuel efficiency in the above conventional technique. However, in the case of repeatedly performing the action of tilting the operation lever in the bucket dumping direction (or bucket crowding direction) and the action of returning the operation lever in a short period of time such as the gravel spreading action, that is, in the case in which the operation amount of the operation lever intermittently and frequently changes in a short period of time, then the responsiveness of the hydraulic actuator deteriorates because of the reduction of the opening area of an auxiliary flow control valve, the bucket slows down by as much as this response delay to make it impossible to appropriately spread gravel, and work accuracy and work efficiency are possibly, greatly declined.

The hydraulic excavator which is an example of work machine according to Embodiment 1, by contrast, includes: the hydraulic pump 41 driven by the prime mover (for example, the engine 22); the multijoint type front work implement 30 configured such that a plurality of driven members including at least the boom 31, the arm 33, and the work tool (for example, the bucket 35) are coupled rotatably; a plurality of hydraulic actuators (for example, the boom cylinder 32, the arm cylinder 34, and the bucket cylinder 36) driven by the pressurized fluid delivered from the hydraulic pump and driving the plurality of driven members; a plurality of directional control valves 43 and 44 controlling the directions and the flow rates of the pressurized fluid supplied from the hydraulic pump to the plurality of hydraulic actuators; a plurality of operation devices (for example, the operation lever devices 51 and 52) controlling the plurality of directional control valves; the operation amount sensors 51*a*, 52*a*, and 52*b* detecting the operation amounts of the operation devices related to at least the boom and the work tool among the plurality of operation devices; the flow restriction device (for example, the variable flow control valve 45) that can restrict the flow rate of the pressurized fluid in at least one of the meter-in passage and the meter-out passage of the directional control valve related to the work tool; and the controller 60 controlling the flow restriction device on the basis of the detection results of the operation amounts from the plurality of operation amount sensors, the controller being configured to be capable of changing over the action mode to any one of the normal mode for restricting the flow rate of the pressurized fluid by the flow restriction device and the responsiveness priority mode for not restricting the flow rate of the pressurized fluid by the flow restriction device in response to the detection results of the operation amounts of the plurality of operation devices. Therefore, it is possible to enhance the responsiveness in the action requiring the responsiveness such as the action in which the operation amount of the operation lever frequently changes in a short period of time without deteriorating workability during the normal operation, and to suppress a decline in work efficiency.

Embodiment 2

Embodiment 2 of the present invention will be described with reference to FIGS. 6 and 7. In Embodiment 2, differences from Embodiment 1 will only be described, and similar members to those in Embodiment 1 are denoted by the same reference characters in the drawings and description thereof will be omitted.

In Embodiment 2, a hydraulic circuit system is configured such that a variable flow control valve is provided in a return hydraulic line between the meter-out passage of the directional control valve related to the bucket cylinder and the hydraulic fluid tank, and that the variable flow control valve is controlled on the basis of the operation amount of the operation lever device and arm cylinder pressures, as an alternative to the variable flow control valve (flow restriction device) disposed in the supply hydraulic line between the meter-in passage of the directional control valve related to the bucket cylinder and the hydraulic pump in Embodiment 1.

Figure 6:
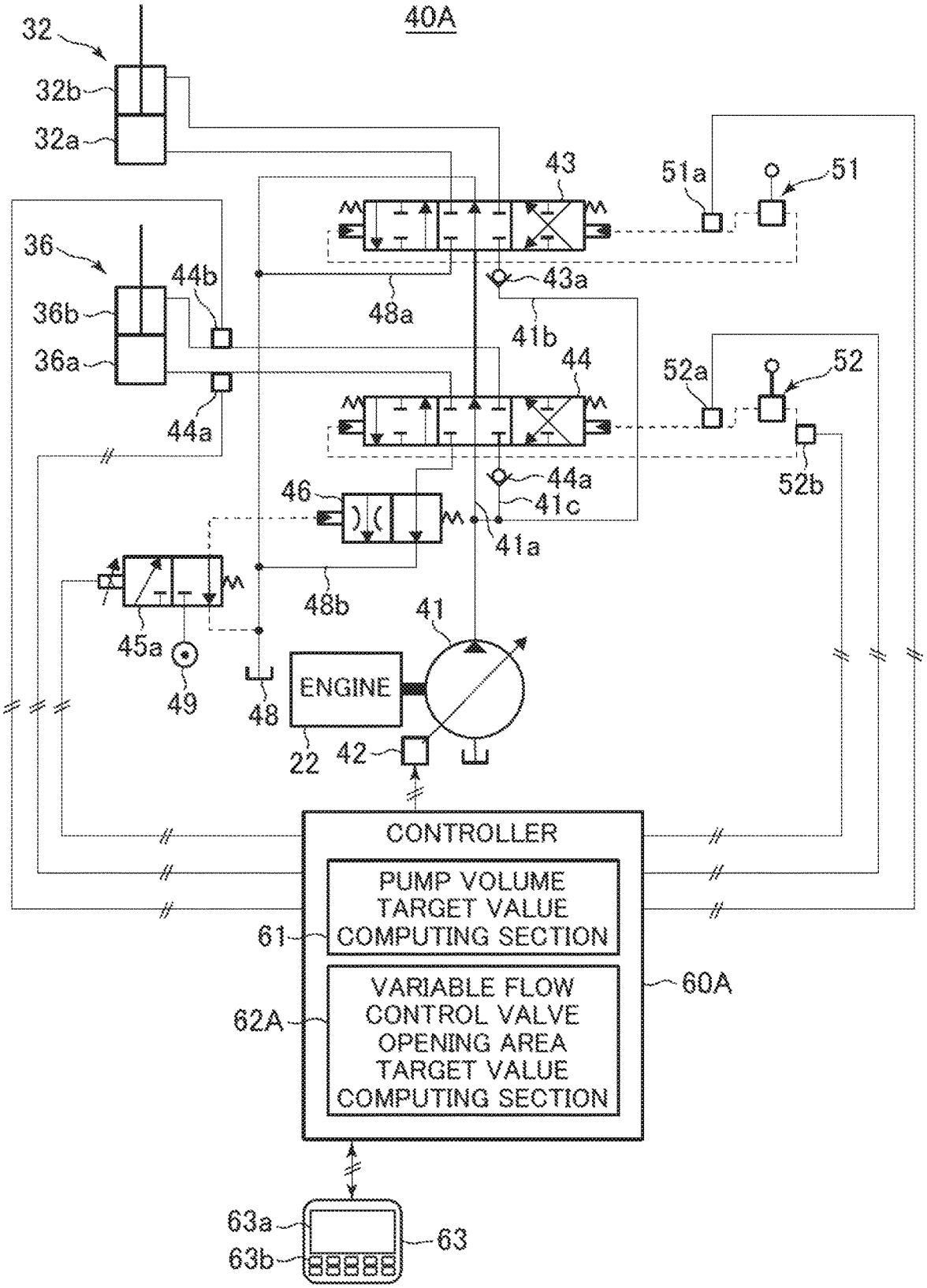
FIG. 6 is a schematic diagram depicting extracted principal parts of a hydraulic circuit system according to Embodiment 2.

FIG. 6 is a schematic diagram depicting extracted principal parts of the hydraulic circuit system according to Embodiment 2.

In FIG. 6, a hydraulic circuit system 40A is configured with the variable displacement hydraulic pump 41 and the fixed displacement pilot pump (pilot hydraulic fluid source) 49 driven by the engine 22, the regulator 42 controlling the pump volume (tilting angle) of the hydraulic pump 41 on the basis of a control signal from a controller 60A that controls entire actions of the hydraulic excavator 100, the directional control valves (spools) 43 and 44 controlling directions and flow rates of the hydraulic fluid supplied from the hydraulic pump 41 to the hydraulic actuators 32 and 36 on the basis of the pilot pressures (operation signals) introduced from operation lever devices 51 and 52 via the pilot hydraulic lines, a solenoid proportional valve 46*a* converting the control signal output from the controller 60A as the electrical signal into the control signal, which is the pilot pressure, and outputting the control signal to a variable flow control valve (variable throttle) 46, and the variable flow control valve (flow restriction device) 46 that can restrict the flow rate of the pressurized fluid (hydraulic fluid) in the meter-in passage of the directional control valve 44 related to the bucket cylinder 36 on the basis of the control signal transmitted from the controller 60A through the solenoid proportional valve 46*a*. The variable flow control valve 46 is disposed in the return hydraulic line 48*b* between the meter-out passage of the directional control valve 44 related to the bucket cylinder 36 that drives the bucket 35 and the hydraulic fluid tank 48 (that is, a hydraulic fluid tank 48-side of the directional control valve 44). It is noted that only the boom cylinder 32 and the bucket cylinder 36 among the plurality of hydraulic actuators and configurations associated with the boom cylinder 32 and the bucket cylinder 36 are extracted and depicted in FIG. 6, and that the other hydraulic actuators and configurations associated with the other hydraulic actuators are not depicted for the brevity of description.

In the case in which the operation lever device 52 operates bucket crowding, then the directional control valve 44 is driven to the left side in FIG. 6 in response to the operation amount of the bucket crowding operation, the pressurized fluid delivered from the hydraulic pump 41 is supplied to the bottom chamber (bucket cylinder bottom chamber) 36*a* of the bucket cylinder 36 via the supply hydraulic line 41*c* and the meter-in passage of the directional control valve 44, and the pressurized fluid in the rod chamber (bucket cylinder rod chamber) 36*b* of the bucket cylinder 36 flows into the hydraulic fluid tank 48 via the meter-out passage of the directional control valve 44 and the variable flow control valve 46 of the return hydraulic line 48*b*, whereby the bucket cylinder 36 extends to perform the bucket crowding action. Likewise, in the case in which the operation lever device 52 operates bucket dumping, then the directional control valve 44 is driven to the right side in FIG. 6 in response to the operation amount of the bucket dumping operation, the pressurized fluid delivered from the hydraulic pump 41 is supplied to the bucket cylinder rod chamber 36*b* via the supply hydraulic line 41*c* and the meter-in passage of the directional control valve 44, and the pressurized fluid in the bucket cylinder bottom chamber 36*a* flows into the hydraulic fluid tank 48 via the meter-out passage of the directional control valve 44 and the variable flow control valve 46 of the return hydraulic line 48*b*, whereby the bucket cylinder 36 contracts to perform the bucket dumping action.

Pressure sensors 44*b* and 44*c* that detect bucket cylinder pressures (a bucket cylinder bottom pressure and a bucket cylinder rod pressure) and that output the bucket cylinder pressures to the controller 60A via signal lines are disposed in hydraulic lines that connect the bottom chamber 36*a* and the rod chamber 36*b* of the bucket cylinder 36 to the directional control valve 44, respectively.

The solenoid proportional valve 46*a* generates the pilot pressure operating the variable flow control valve 46 on the basis of the control signal output from the controller 60A as the electrical signal, and it may be said that the solenoid proportional valve 46*a* converts the control signal output from the controller 60A as the electrical signal into the control signal which is the pilot pressure. A position of the solenoid proportional valve 46*a* is changed over to a position depicted in FIG. 6 in a case in which the control signal is not input to the solenoid proportional valve 46*a* from the controller 60A, and the control signal (pilot pressure) to be output to the variable flow control valve 46 is kept at the tank pressure. Furthermore, in a case in which the control signal is input to the solenoid proportional valve 46*a* from the controller 60A, the solenoid proportional valve 46*a* moves in the upward direction in FIG. 6 in proportion to an increase in the control signal and the control signal (pilot pressure) to act on the variable flow control valve 46 increases. It is noted that a relationship among the control signal (electrical signal) output from the controller 60A, the control signal (pilot pressure) generated by the solenoid proportional valve 46*a,* and an opening area of the variable flow control valve 46 is calculated in advance, and stored in the controller 60A.

The variable flow control valve 46 is the flow regulation device that regulates the flow rate of the pressurized fluid flowing from the bucket cylinder 36 to the hydraulic fluid tank 48 via the directional control valve 44 by changing the opening area of the variable flow control valve 46 on the basis of the control signal input from the controller 60A via the solenoid proportional valve 46*a.* The variable flow control valve 46 is kept at a position (at which the opening area is a maximum) depicted in FIG. 6 when the control signal (pilot pressure) from the solenoid proportional valve 46*a* is equal to the tank pressure, and moves in the rightward direction in FIG. 6 in proportion to the increase in the control signal to reduce the opening area.

The variable flow control valve 46 has functions of reducing the opening area and restricting the flow rate of the pressurized fluid flowing from the bucket cylinder 36 into the hydraulic fluid tank 48 (that is, restricting the flow rate of the pressurized fluid flowing into the bucket cylinder 36 as a result) at the time of simultaneously operating boom raising and bucket crowding or boom raising and bucket dumping, thereby making it possible to maintain high the delivery pressure of the hydraulic pump 41 and to perform the simultaneous actions of the bucket 36 and the boom 31 even in the case of operating the bucket 35 in midair. Furthermore, the variable flow control valve 46 also has a function of making smaller the opening area of the variable flow control valve 46 as a thrust that acts on a piston of the bucket cylinder 36 is greater in a case in which a direction of the thrust is opposite to that of a thrust estimated from an operating direction of the operation lever device 52 (that is, in a case in which the bucket cylinder 36 is braking), thereby suppressing a cylinder speed of the bucket cylinder 36 to prevent cavitation.

The controller 60A controls the entire actions of the hydraulic excavator 100, and is configured with the pump volume target value computing section 61 that computes the control signal to be output to the regulator 42 on the basis of the detection results from the operation amount sensors 51*a,* 52*a,* and 52*b* (which are the detection values of the pilot pressures (operation signals) introduced from the operation lever devices 51 and 52 via the pilot hydraulic lines and which correspond to the operation amounts of the operation lever devices 51 and 52), thereby controlling the pump volume of the hydraulic pump 41 and controlling the delivery flow rate thereof, and a variable flow control valve opening area target value computing section 62A that computes the control signal to be output to the variable flow control valve 46 disposed in the return hydraulic line 48*b* between the meter-out passage of the bucket cylinder 36 and the hydraulic fluid tank 48 (that is, the control signal generated by the solenoid proportional valve 46*a*) on the basis of the detection results from the operation amount sensors 51*a,* 52*a,* and 52*b* and detection results from the pressure sensors 44*b* and 44*c,* thereby controlling the opening area of the variable flow control valve 46.

Figure 7:
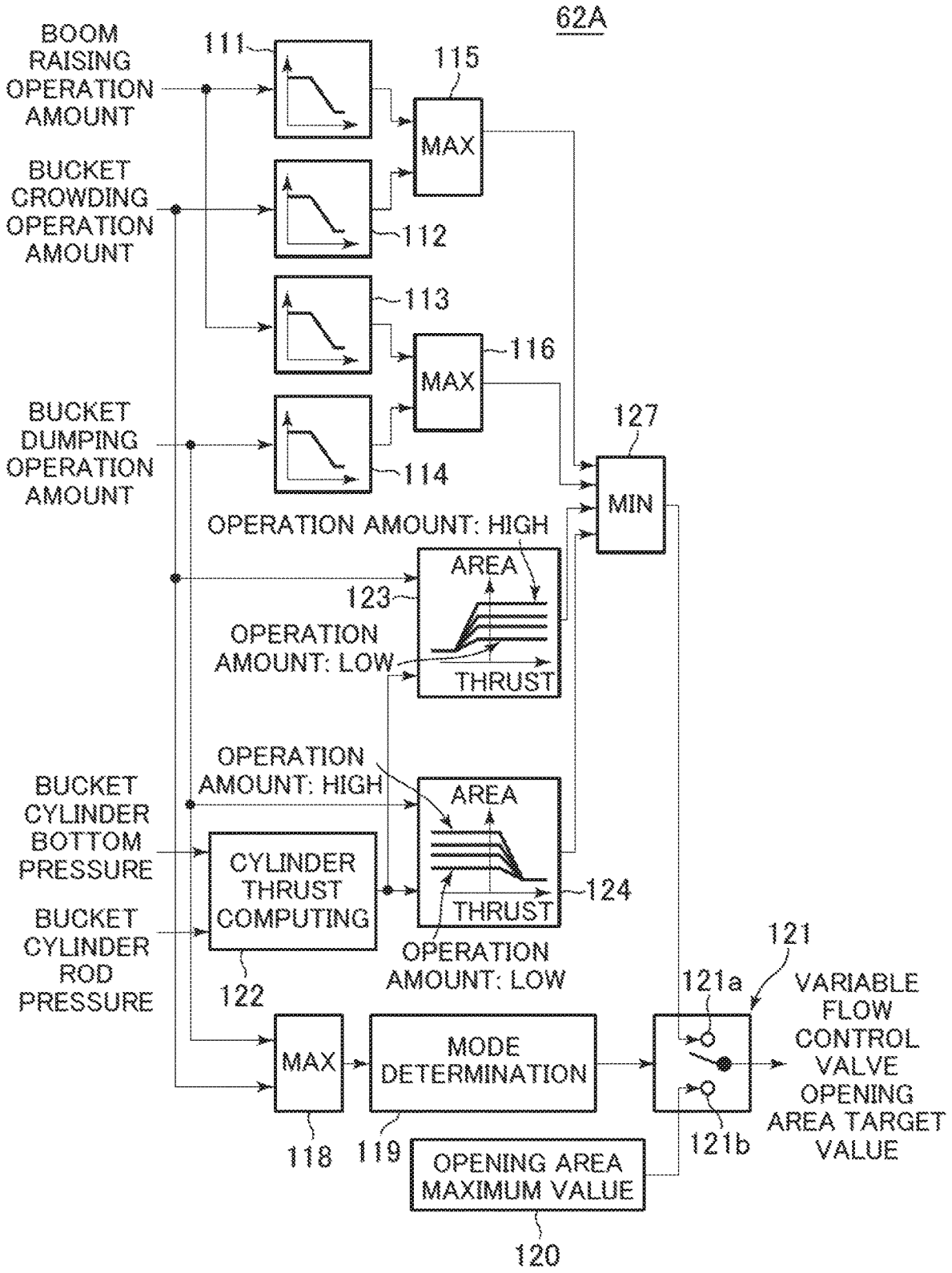
FIG. 7 is a functional block diagram depicting process contents of a variable flow control valve opening area target value computing section according to Embodiment 2.

FIG. 7 is a functional block diagram depicting process contents of the variable flow control valve opening area target value computing section according to Embodiment 2.

In FIG. 7, the variable flow control valve opening area target value computing section 62A is configured with the computing section 111 that calculates one of candidate values of a variable flow control valve opening area target value on the basis of the boom raising operation amount and the preset table, the computing section 112 that calculates one of the candidate values of the variable flow control valve opening area target value on the basis of the bucket crowding operation amount and the preset table, the maximum value selection section 115 that selects the maximum value out of the computation results of the computing sections 111 and 112, the computing section 113 that calculates one of the candidate values of the variable flow control valve opening area target value on the basis of the boom raising operation amount and the preset table, the computing section 114 that calculates one of the candidate values of the variable flow control valve opening area target value on the basis of the bucket dumping operation amount and the preset table, the maximum value selection section 116 that selects the maximum value out of the computation results of the computing sections 113 and 114, a cylinder thrust computing section 122 that calculates the thrust of the bucket cylinder (bucket cylinder thrust) on the basis of the bucket cylinder bottom pressure and the bucket cylinder rod pressure, a computing section 123 that calculates one of the candidate values of the variable flow control valve opening area target value on the basis of a computation result of the cylinder thrust computing section 122, the bucket crowding operation amount, and a preset table, a computing section 124 that calculates one of the candidate values of the variable flow control valve opening area target value on the basis of the computation result of the cylinder thrust computing section 122, the bucket dumping operation amount, and a preset table, a minimum value selection section 127 that selects a minimum value out of the computation results selected by the maximum value selection sections 115 and 116 and computation results of the computing sections 123 and 124, the maximum value selection section 118 that selects the maximum value out of the bucket crowding operation amount and the bucket dumping operation amount, the opening area maximum value 120 that is set as one of the candidate values of the variable flow control valve opening area target value, the mode determination section 119 that determines whether the action mode suited for the action of the front device 30 is "normal mode" or "responsiveness priority mode" on the basis of the selection result of the maximum value selection section 118, and the output value changeover section 121 that changes over an output value in such a manner as to output any one of a selection result of the minimum value selection section 127 (input 121*a* side) and the opening area maximum value 120 (input 121*b* side) as a computation result of the variable flow control valve opening area target value computing section 62A (variable flow control valve opening area target value) on the basis of the determination result of the mode determination section 119.

The cylinder thrust computing section 122 calculates the bucket cylinder thrust (=cylinder bottom area×Pa−cylinder rod area×Pb) on the basis of a pressure Pa of the bucket cylinder bottom chamber 36*a* and a pressure Pb of the bucket cylinder rod chamber 36*b.* The cylinder bottom area (pressure receiving area of the piston in the bucket cylinder bottom chamber 36*a*) and the cylinder rod area (pressure receiving area of the piston in the bucket cylinder rod chamber 36*b*) are calculated in advance and stored in the controller 60A. The bucket cylinder thrust takes on a positive value in a case in which the thrust acts on an extension direction of the bucket cylinder 36 (that is, bucket crowding direction), and takes on a negative value in a case in which the thrust acts on a contraction direction of the bucket cylinder 36 (that is, bucket dumping direction).

The computing section 123 calculates one of the candidate values of the variable flow control valve opening area target value on the basis of the computation result of the cylinder thrust computing section 122, the bucket crowding operation amount, and the preset table. In FIG. 7, a graph-like table with a horizontal axis representing the cylinder thrust (computation result of the cylinder thrust computing section 122) and a vertical axis representing the candidate value of the variable flow control valve opening area target value is exemplarily depicted as the table preset to the computing section 123. This table is set such that the candidate value of the variable flow control valve opening area target value increases in proportion to an increase in the bucket crowding operation amount regardless of the bucket cylinder thrust in a case in which the bucket cylinder thrust is positive or is greater than a preset negative value. In addition, this table is set such that the candidate value of the variable flow control valve opening area target value decreases in proportion to a reduction in the bucket cylinder thrust or a reduction in the bucket crowding operation amount in a case in which the bucket cylinder thrust is equal to or smaller than the preset negative value.

The computing section 124 calculates one of the candidate values of the variable flow control valve opening area target value on the basis of the computation result of the cylinder thrust computing section 122, the bucket dumping operation amount, and the preset table. In FIG. 7, a graph-like table with a horizontal axis representing the cylinder thrust (computation result of the cylinder thrust computing section 122) and a vertical axis representing the candidate value of the variable flow control valve opening area target value is exemplarily depicted as the table preset to the computing section 124. This table is set such that the candidate value of the variable flow control valve opening area target value increases in proportion to an increase in the bucket dumping operation amount regardless of the bucket cylinder thrust in a case in which the bucket cylinder thrust is negative or is smaller than a preset positive value. In addition, this table is set such that the candidate value of the variable flow control valve opening area target value decreases in proportion to an increase in the bucket cylinder thrust or a reduction in the bucket dumping operation amount in a case in which the bucket cylinder thrust is equal to or greater than the preset positive value.

The output value changeover section 121 outputs the selection result of the minimum value selection section 117 (input 121*a* side) as the computation result of the variable flow control valve opening area target value computing section 62A (variable flow control valve opening area target value) in the case in which the determination result of the mode determination section 119 is "normal mode," and outputs the opening area maximum value 120 (input 121*b* side) as the variable flow control valve opening area target value in the case in which the determination result is "responsiveness priority mode."

The other configurations are similar to those in Embodiment 1.

Functions and advantages of Embodiment 2 configured as described so far will be described.

In a case in which the work machine 100 according to Embodiment 2 performs work in which the operation amount of the operation lever device 52 changes intermittently and frequently in a short period of time, that is, in a case of repeating the action of tilting the operation lever device 52 in the bucket dumping direction (or bucket crowding direction) and the action of returning the operation lever device 52 in a short period of time, for example, the gravel spreading action or the screening action, the responsiveness priority mode is set in the mode determination process. In the case in which the responsiveness priority mode is set, the variable flow control valve opening area target value computing section 62A sets large the opening area target value of the variable flow control valve 46 (for example, sets the opening area target value to the opening area maximum value at which the flow rate of the pressurized fluid is not restricted by the variable flow control valve 46). It is thereby possible to enhance the packet operation responsiveness in the action of changing the operation amount of the operation lever device 52 intermittently and frequently.

Furthermore, in the case of performing the normal operation other than the operation in which the responsiveness priority mode is set, the normal mode is set in the mode determination process. In the case in which the normal mode is set, the variable flow control valve opening area target value computing section 62A sets small the opening area target value of the variable flow control valve 46 in response to the operation amounts of the operation lever devices 51 and 52 to restrict the flow rate of the pressurized fluid flowing to the bucket cylinder 36. It is thereby possible to maintain high the delivery pressure of the hydraulic pump 41 and to appropriately perform the simultaneous actions of the bucket 35 and the boom 31 even in the case of operating the bucket 35 in midair at the time of simultaneously operating the boom raising and the bucket crowding or the boom raising and the bucket dumping. Furthermore, the variable flow control valve opening area target value computing section 62A suppresses the cylinder speed of the bucket cylinder 36 to prevent cavitation by making smaller the opening area of the variable flow control valve 46 as the thrust that acts on the piston of the bucket cylinder 36 is greater in the case in which the direction of the thrust is opposite to that of the thrust estimated from the operating direction of the operation lever device 52 (that is, in the case in which the bucket cylinder 36 is braking).

In Embodiment 2, a case in which the variable flow control valve 46 is provided in the return hydraulic line 48*b* between the meter-out passage of the directional control valve 44 related to the bucket cylinder 36 and the hydraulic fluid tank 48, and in which computation is performed and control is exercised using the bucket crowding operation amount, the bucket dumping operation amount, the bucket cylinder bottom pressure, and the bucket cylinder rod pressure has been exemplarily described. However, the present invention is not limited to this case and the hydraulic circuit system 40A may be configured, for example, such that a variable flow control valve is provided in a return hydraulic line between the meter-out passage of a directional control valve (not depicted) related to the arm cylinder 34 and the hydraulic fluid tank 48, and that computation is performed and control is exercised using an arm crowding operation amount, an arm dumping operation amount, an arm cylinder bottom pressure, and an arm cylinder rod pressure.

Embodiment 3

Embodiment 3 of the present invention will be described with reference to FIGS. 8 and 9. In Embodiment 3, differences from Embodiment 2 will only be described, and similar members to those in Embodiment 1 are denoted by the same reference characters in the drawings and description thereof will be omitted.

In Embodiment 3, a hydraulic circuit system is configured such that pressure reducing valves (flow restriction devices) are provided in pilot hydraulic lines introducing the control signals (pilot pressures) to the directional control valve related to the bucket cylinder, the pressure reducing valves are controlled on the basis of the operation amount of the operation lever device and the arm cylinder pressures, and opening areas of the meter-in passage and the meter-out passage of the directional control valve related to the bucket cylinder are controlled, as an alternative to the variable flow control valve (flow restriction device) disposed in the return hydraulic line between the meter-out passage related to the bucket cylinder and the hydraulic fluid tank in Embodiment 2.

Figure 8:
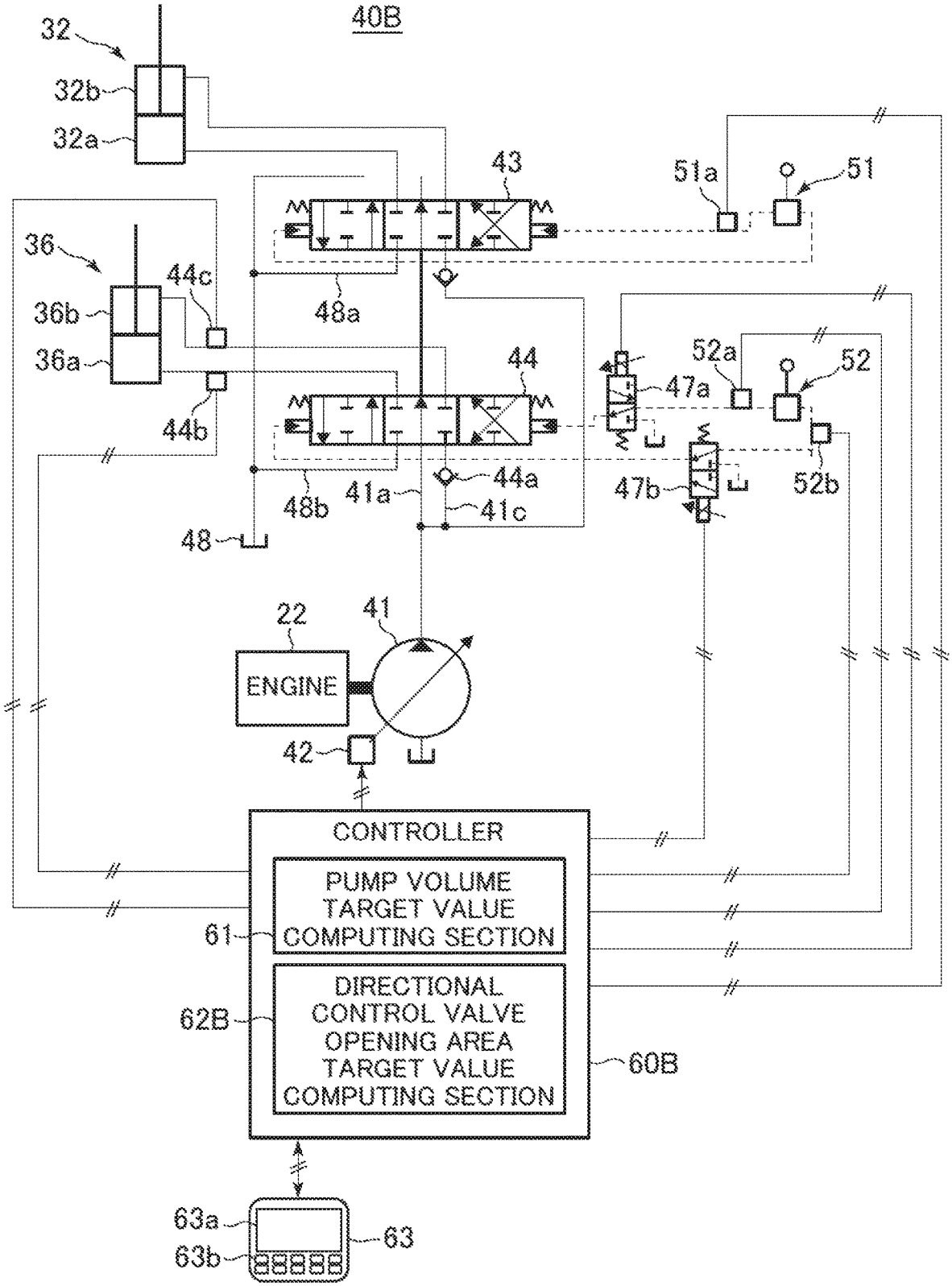
FIG. 8 is a schematic diagram depicting extracted principal parts of a hydraulic circuit system according to Embodiment 3.

FIG. 8 is a schematic diagram depicting extracted principal parts of the hydraulic circuit system according to Embodiment 3.

In FIG. 8, a hydraulic circuit system 40B is configured with the variable displacement hydraulic pump 41 and the fixed displacement pilot pump (pilot hydraulic fluid source) 49 driven by the engine 22, the regulator 42 controlling the pump volume (tilting angle) of the hydraulic pump 41 on the basis of a control signal from a controller 60B that controls the entire actions of the hydraulic excavator 100, the directional control valves (spools) 43 and 44 controlling the directions and the flow rates of the hydraulic fluid supplied from the hydraulic pump 41 to the hydraulic actuators 32 and 36 on the basis of the pilot pressures (operation signals) introduced from the operation lever devices 51 and 52 via the pilot hydraulic lines, and pressure reducing valves (flow restriction devices) 47*a* and 47*b* that can restrict the control signal (pilot pressure) output from the operation lever device 52 to the directional control valve 44 on the basis of the control signal from the controller 60B. The pressure reducing valve 47*a* is disposed in the pilot hydraulic line for a control signal (pilot pressure) that is a bucket crowding instruction from the operation lever device 52, and the pressure reducing valve 47*b* is disposed in the pilot hydraulic line for a control signal (pilot pressure) that is a bucket dumping instruction from the operation lever device 52. It is noted that only the boom cylinder 32 and the bucket cylinder 36 among the plurality of hydraulic actuators and configurations associated with the boom cylinder 32 and the bucket cylinder 36 are extracted and depicted in FIG. 8, and that the other hydraulic actuators and configurations associated with the other hydraulic actuators are not depicted for the brevity of description.

The pressure reducing valves 47*a* and 47*b* are pressure control valves that control the pilot pressures in the pilot hydraulic lines, and each configure the flow restriction device that can restrict the flow rate of the pressurized fluid in at least one of the meter-in passage and the meter-out passage of the directional control valve 44 related to the bucket cylinder 36 by restricting the control signal (pilot pressure) transmitted from the operation lever device 52 to the directional control valve 44. In a case in which the control signal is not output from the controller 60B, then the pressure reducing valve 47*a* is kept at a position depicted in FIG. 8, causes the control signal (pilot pressure) from the operation lever device 52 to directly act on the directional control valve 44, moves in a downward direction in FIG. 8 in proportion to an increase in the control signal from the controller 60B, and reduces the control signal (pilot pressure) acting on the directional control valve 44. Likewise, in a case in which the control signal is not output from the controller 60B, then the pressure reducing valve 47*b* is kept at a position depicted in FIG. 8, causes the control signal (pilot pressure) from the operation lever device 52 to directly act on the directional control valve 44, moves in the upward direction in FIG. 8 in proportion to the increase in the control signal from the controller 60B, and reduces the control signal (pilot pressure) acting on the directional control valve 44. It is noted that a relationship among the control signal (electrical signal) output from the controller 60B, the control signals (pilot pressures) reduced by the pressure reducing valves 47 and 47*b*, and the opening area of at least one of the meter-in passage and the meter-out passage of the directional control valve 44 is calculated in advance, and stored in the controller 60B.

Each of the pressure reducing valves 47*a* and 47*b* has functions of reducing the opening areas of the meter-in passage and the meter-out passage of the directional control valve 44 and restricting the flow rate of the pressurized fluid supplied from the hydraulic pump 41 to the bucket cylinder 36 by restricting (reducing) the pilot pressure driving the directional control valve 44 related to the bucket cylinder 36 at the time of simultaneously operating boom raising and bucket crowding or boom raising and bucket dumping, thereby making it possible to maintain high the delivery pressure of the hydraulic pump 41 and to perform the simultaneous actions of the bucket 35 and the boom 31 even in the case of operating the bucket 35 in midair. Furthermore, in the case in which the direction of the thrust that acts on the piston of the bucket cylinder 36 is opposite to that of the thrust estimated from the operating direction of the operation lever device 52 (that is, in the case in which the bucket cylinder 36 is braking), each of the pressure reducing valves 47*a* and 47*b* also has a function of making smaller the opening areas of the meter-in passage and the meter-out passage of the directional control valve 44 to restrict the flow rate of the pressurized fluid discharged from the bucket cylinder 36 into the hydraulic fluid tank 48 by restricting (reducing) the pilot pressure driving the directional control valve 44 related to the bucket cylinder 36 as the thrust is greater, thereby suppressing the cylinder speed of the bucket cylinder 36 and preventing cavitation.

The controller 60B controls the entire actions of the hydraulic excavator 100, and is configured with the pump volume target value computing section 61 that computes the control signal to be output to the regulator 42 on the basis of the detection results from the operation amount sensors 51*a*, 52*a*, and 52*b* (which are the detection values of the pilot pressures (operation signals) introduced from the operation lever devices 51 and 52 via the pilot hydraulic lines and which correspond to the operation amounts of the operation lever devices 51 and 52), thereby controlling the pump volume of the hydraulic pump 41 and controlling the delivery flow rate thereof, and a directional control valve opening area target value computing section 62B that controls an opening area of the pressure reducing valve 47*a* or 47*b* on the basis of the detection results from the operation amount sensors 51*a*, 52*a*, and 52*b* and the pressure sensors 44*b* and 44*c*, thereby controlling the opening areas of the meter-in passage and the meter-out passage of the directional control valve 44.

Figure 9:
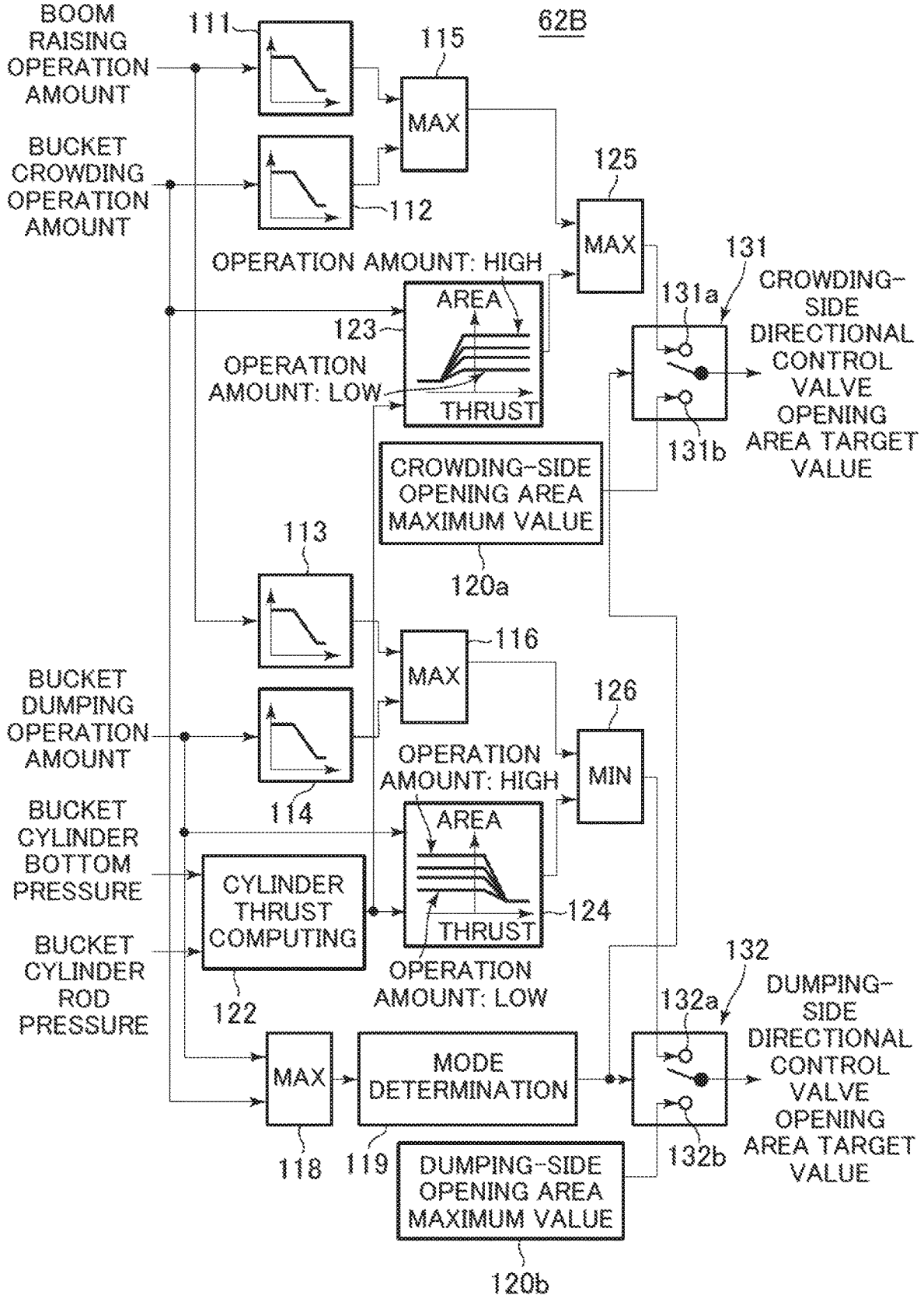
FIG. 9 is a functional block diagram depicting process contents of a directional control valve opening area target value computing section according to Embodiment 3.

FIG. 9 is a functional block diagram depicting process contents of the directional control valve opening area target value computing section according to Embodiment 3. While a case of computing the opening area of the meter-out passage of the directional control valve 44 (directional control valve opening area) is described hereinafter by way of example, the opening area of the meter-in passage of the directional control valve 44 (directional control valve opening area) can be similarly computed and a similar advantage can be obtained.

In FIG. 9, the directional control valve opening area target value computing section 62B is configured with the computing section 111 that calculates one of candidate values of a directional control valve opening area target value on the basis of the boom raising operation amount and the preset table, the computing section 112 that calculates one of the candidate values of the directional control valve opening area target value on the basis of the bucket crowding operation amount and the preset table, the maximum value selection section 115 that selects the maximum value out of the computation results of the computing sections 111 and 112, the computing section 113 that calculates one of the candidate values of the directional control valve opening area target value on the basis of the boom raising operation amount and the preset table, the computing section 114 that calculates one of the candidate values of the directional control valve opening area target value on the basis of the bucket dumping operation amount and the preset table, the maximum value selection section 116 that selects the maximum value out of the computation results of the computing sections 113 and 114, the cylinder thrust computing section 122 that calculates the thrust of the bucket cylinder (bucket cylinder thrust) on the basis of the bucket cylinder bottom pressure and the bucket cylinder rod pressure, the computing section 123 that calculates one of the candidate values of the directional control valve opening area target value on the basis of the computation result of the cylinder thrust computing section 122, the bucket crowding operation amount, and the preset table, the computing section 124 that calculates one of the candidate values of the directional control valve opening area target value on the basis of the computation result of the cylinder thrust computing section 122, the bucket dumping operation amount, and the preset table, a minimum value selection section 125 that selects a minimum value out of the computation result selected by the maximum value selection section 115 and a computation result of the computing section 123, a minimum value selection section 126 that selects a minimum value out of the computation result selected by the maximum value selection section 116 and a computation result of the computing section 124, the maximum value selection section 118 that selects the maximum value out of the bucket crowding operation amount and the bucket dumping operation amount, the mode determination section 119 that determines whether the action mode suited for the action of the front device 30 is "normal mode" or "responsiveness priority mode" on the basis of the selection result of the maximum value selection section 118, an opening area maximum value 120*a* that is set as one of candidate values of an opening area target value of the meter-out passage of the bucket crowding-side directional control valve 44, an output value changeover section 131 that changes over an output value in such a manner as to output any one of a selection result of the minimum value selection section 125 (input 131*a* side) and the opening area maximum value 120*a* (input 131*b* side) as a computation result of the directional control valve opening area target value computing section 62B for the meter-out passage of the bucket crowding-side directional control valve 44 (crowding-side directional control valve opening area target value) on the basis of the determination result of the mode determination section 119, an opening area maximum value 120*b* that is set as one of candidate values of an opening area target value of the meter-out passage of the bucket dumping-side directional control valve 44, and an output value changeover section 132 that changes over an output value in such a manner as to output any one of a selection result of the minimum value selection section 126 (input 132*a* side) and the opening area maximum value 120*b* (input 132*b* side) as a computation result of the directional control valve opening area target value computing section 62B for the meter-out passage of the bucket crowding-side directional control valve (dumping-side directional control valve opening area target value) on the basis of the determination result of the mode determination section 119.

The other configurations are similar to those in Embodiment 1.

Functions and advantages of Embodiment 3 configured as described so far will be described.

In the case in which the work machine 100 according to Embodiment 3 performs work in which the operation amount of the operation lever device 52 changes intermittently and frequently in a short period of time, that is, in the case of repeating the action of tilting the operation lever device 52 in the bucket dumping direction (or bucket crowding direction) and the action of returning the operation lever device 52 in a short period of time, for example, the gravel spreading action or the screening action, the responsiveness priority mode is set in the mode determination process. In the case in which the responsiveness priority mode is set, the directional control valve opening area target value computing section 62B sets large the opening area target value of the directional control valve 44 (for example, sets the opening area target value to an opening area maximum value at which the pilot pressure is not restricted by the pressure reducing valve 47*a* or 47*b*), and the pilot pressure (control signal) generated by the operation lever device 52 is input to the directional control valve 44 without being regulated (restricted). It is thereby possible to make large the opening areas of the meter-in side and the meter-out side of the directional control valve 44 related to the bucket cylinder 36 (to correspond to the operation amount of the operation lever device 52), and to enhance the packet operation responsiveness in the action of changing the operation amount of the operation lever device 52 intermittently and frequently.

Furthermore, in the case of performing the normal operation other than the operation in which the responsiveness priority mode is set, the normal mode is set in the mode determination process. In the case in which the normal mode is set, then the directional control valve opening area target value computing section 62B sets small the opening area target value of the directional control valve 44 in response to the operation amount of the operation lever device 51, and the pilot pressure (control signal) generated by the operation lever device 52 is regulated (restricted) and input to the directional control valve 44. It is thereby possible to regulate the opening areas of the meter-in side and the meter-out side of the directional control valve 44 for the bucket cylinder 36 to be small (restricted to be smaller than those corresponding to the operation amount of the operation lever device 52), and to maintain high the delivery pressure of the hydraulic pump 41 and to appropriately perform the simultaneous actions of the bucket 35 and the boom 31 even in the case of operating the bucket 35 in midair at the time of simultaneously operating the boom raising and the bucket crowding or the boom raising and the bucket dumping. Furthermore, the directional control valve opening area target value computing section 62B regulates (restricts) the pilot pressure (control signal) input from the operation lever device 52 to the directional control valve 44 by making smaller the opening area target value of the directional control valve 44 as the thrust that acts on the piston of the bucket cylinder 36 is greater in the case in which the direction of the thrust is opposite to that of the thrust estimated from the operating direction of the operation lever device 52 (that is, in the case in which the bucket cylinder 36 is braking). It is thereby possible to regulate the opening areas of the meter-in side and the meter-out side of the directional control valve 44 for the bucket cylinder 36 to be small (restricted to be smaller than those corresponding to the operation amount of the operation lever device 52), and to suppress the cylinder speed of the bucket cylinder 36 to prevent cavitation.

In Embodiment 3, a case in which the pressure reducing valves 47*a* and 47*b* are provided in the pilot hydraulic lines of the directional control valve 44 related to the bucket cylinder 36, and in which computation is performed and control is exercised using the bucket crowding operation amount, the bucket dumping operation amount, the bucket cylinder bottom pressure, and the bucket cylinder rod pressure has been exemplarily described. However, the present invention is limited to this case and the hydraulic circuit system 40B may be configured, for example, such that pressure reducing valves are provided in pilot hydraulic lines of the directional control valve (not depicted) corresponding to the arm cylinder 34, and that computation is performed and control is exercised using the arm crowding operation amount, the arm dumping operation amount, the arm cylinder bottom pressure, and the arm cylinder rod pressure.

Modification of Embodiments 1-3

A modification of Embodiments 1 to 3 will be described with reference to FIGS. 10 to 12.

In the present modification, a hydraulic circuit system is configured such that it is possible to set whether a changeover of the action mode from the normal mode to the responsiveness priority mode is possible for every work mode set in response to a content of work performed by the front work implement in Embodiments 1 to 3.

Figure 10:
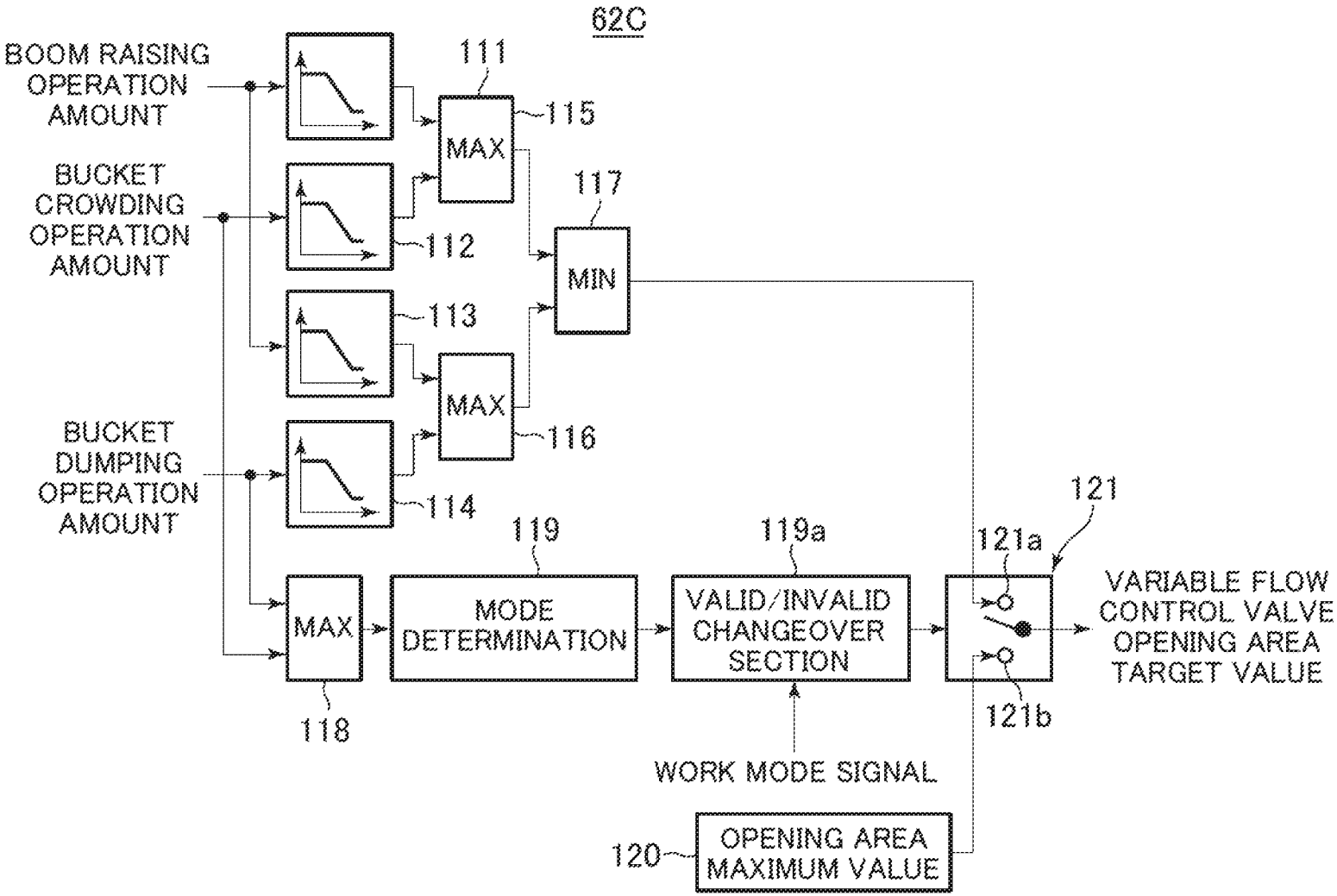
FIG. 10 is a functional block diagram depicting process contents of a variable flow control valve opening area target value computing section according to a modification.

FIG. 10 is a functional block diagram depicting process contents of a variable flow control valve opening area target value computing section according to the present embodiment. While a case of providing a valid/invalid changeover section 119*a* for the responsiveness priority mode in the functional block diagram depicted in FIG. 4 according to Embodiment 1 has been depicted in FIG. 10 and described by way of example, the variable flow control valve opening area target value computing section may be configured such that the valid/invalid changeover section 119*a* is provided in an output of the mode determination section 119 in the functional block diagram depicted in FIG. 7 according to Embodiment 2 or depicted in FIG. 9 according to Embodiment 3 and similar advantages to those of the present modification can be obtained.

In FIG. 10, a variable flow control valve opening area target value computing section 62C is configured with the computing section 111 that calculates one of candidate values of the variable flow control valve opening area target value on the basis of the boom raising operation amount and the preset table, the computing section 112 that calculates one of the candidate values of the variable flow control valve opening area target value on the basis of the bucket crowding operation amount and the preset table, the maximum value selection section 115 that selects the maximum value out of the computation results of the computing sections 111 and 112, the computing section 113 that calculates one of the candidate values of the variable flow control valve opening area target value on the basis of the boom raising operation amount and the preset table, the computing section 114 that calculates one of the candidate values of the variable flow control valve opening area target value on the basis of the bucket dumping operation amount and the preset table, the maximum value selection section 116 that selects the maximum value out of the computation results of the computing sections 113 and 114, the minimum value selection section 117 that selects the minimum value out of the computation results selected by the maximum value selection sections 115 and 116, the maximum value selection section 118 that selects the maximum value out of the bucket crowding operation amount and the bucket dumping operation amount, the opening area maximum value 120 that is set as one of the candidate values of the variable flow control valve opening area target value, the mode determination section 119 that determines whether an action mode suited for an action of the front device 30 is "normal mode" or "responsiveness priority mode," to be described later, on the basis of the selection result of the maximum value selection section 118, a valid/invalid changeover section 119*a* that changes over between valid and invalid as to whether to output the determination result of the determination made by the mode determination section 119 as a control signal on the basis of a work mode signal (to be described later) from the input/output device (work mode setting device) 63 and a preset valid/invalid determination table 300 (refer to subsequent FIG. 12), and the output value changeover section 121 that changes over an output value in such a manner as to output any one of the selection result of the minimum value selection section 117 (input 121*a* side) and the opening area maximum value 120 (input 121*b* side) as the computation result of the variable flow control valve opening area target value computing section (variable flow control valve opening area target value) on the basis of the control signal from the valid/invalid changeover section 119*a*.

The work mode signal input to the valid/invalid changeover section 119*a* is output to correspond to a work mode set by the input/output device (work mode setting device) 63 and is set by the operator in response to the content of the work performed by the front work implement 30. The valid/invalid changeover section 119*a* changes over between whether to make valid the determination result that indicates the responsiveness priority mode and whether to make invalid the determination result out of the determination results of the determination made by the mode determination section 119 on the basis of the work mode signal and the preset valid/invalid determination table. Specifically, the valid/invalid changeover section 119*a* determines whether to set valid or invalid in the valid/invalid determination table for the work mode based on the work mode signal, and outputs the determination result of the determination made by the mode determination section 119 (that is, "normal mode" or "responsiveness priority mode") directly as the control signal to the output value changeover section 121 in a case in which valid is set. Furthermore, in a case in which invalid is set for the work mode based on the work mode signal, the valid/invalid changeover section 119*a* determines that the responsiveness priority mode is invalid, and outputs "normal mode" as the control signal to the output value changeover section 121 regardless of the determination result of the determination made by the mode determination section 119 (that is, regardless of whether the determination result is "normal mode" or "responsiveness priority mode").

It is noted that the valid/invalid determination table may be configured to be set by the input/output device 63 and stored in the valid/invalid changeover section 119*a*.

The output value changeover section 121 outputs the selection result of the minimum value selection section 117 (input 121*a* side) as the computation result of the variable flow control valve opening area target value computing section (variable flow control valve opening area target value) in a case in which the control signal from the valid/invalid changeover section 119*a* indicates "normal mode," and outputs the opening area maximum value 120 (input 121*b* side) as the variable flow control valve opening area target value in a case in which the control signal indicates "responsiveness priority mode."

Figure 11:
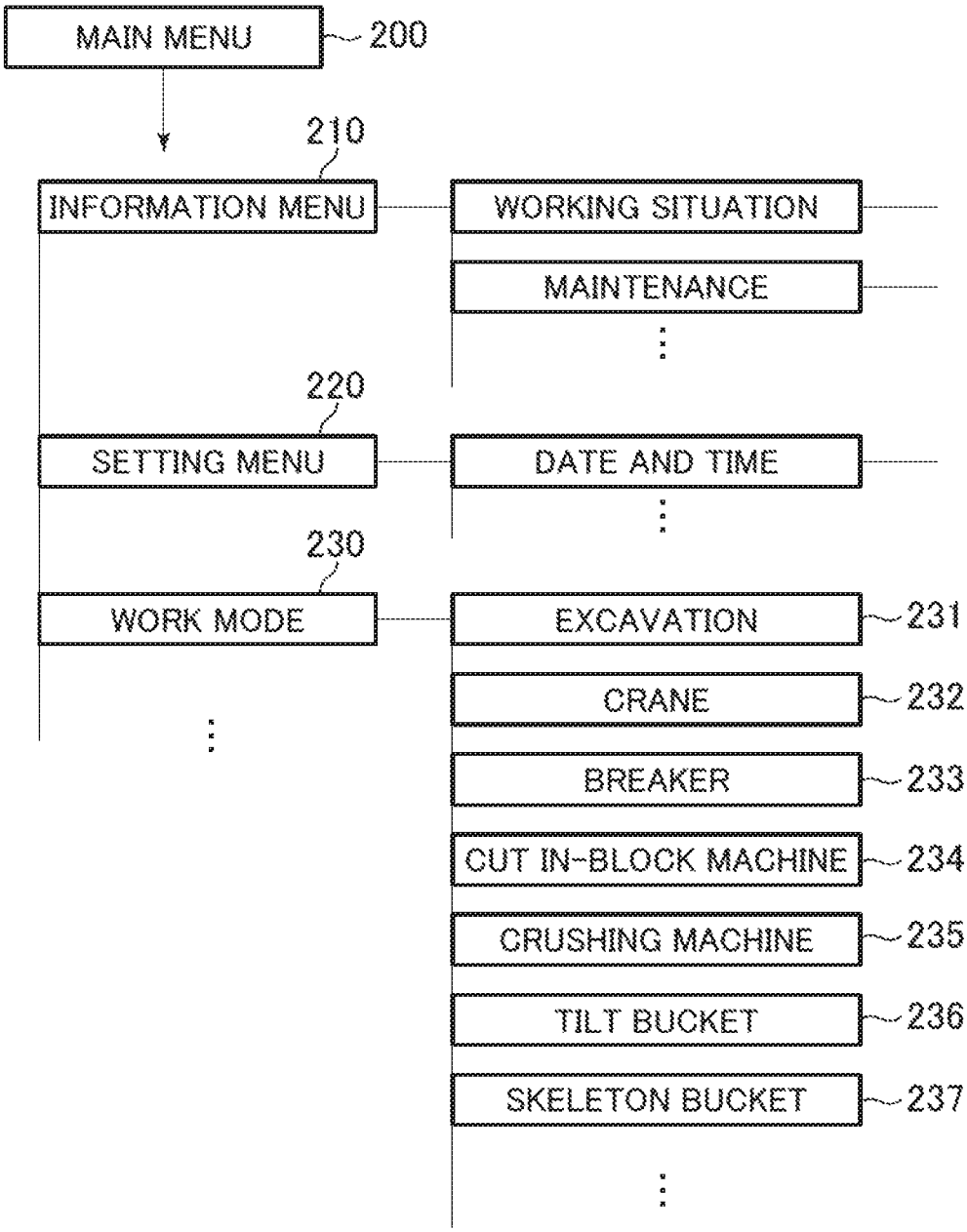
FIG. 11 is a view depicting an example of a setting menu configuration displayed on a monitor (display device) of an input/output device.

FIG. 11 is a view depicting an example of a configuration of a setting menu displayed on the monitor (display device) of the input/output device.

As depicted in FIG. 11, information that can be displayed on the monitor 63*a* of the input/output device 63 by operator's operating the operation switch group 63*b* include not only an information menu 210, a setting menu 220, and the like displayed by selection on a main menu 200 but also a work mode setting menu 230 for setting a work mode in response to the content of the work performed by the front work implement 30 and the like. When the work mode setting menu 230 is selected, an excavation mode 231, a crane mode 232, a breaker mode 233, a cut in-block machine mode 234, a crushing machine mode 235, a tilt bucket mode 236, and a skeleton bucket mode 237, for example, are displayed as work modes, and operator's selecting a desired work mode leads to setting of the work mode. The work mode signal is output from the input/output device 63 to the variable flow control valve opening area target value computing section 62 of the controller 60 in response to the set work mode.

FIG. 12 is a view depicting an example of the valid/invalid determination table for determining whether a changeover to the responsiveness priority mode is possible for every work mode.

In FIG. 12, the valid/invalid determination table 300 is configured with a plurality of types of work modes 301 and setting states 302 as to whether a changeover to the responsiveness priority mode set to correspond to each work mode is possible, that is, valid or invalid. In the valid/invalid determination table 300, the changeover to the responsiveness priority mode is set invalid in the crane mode 232 that requires a delicate action, the breaker mode 233 that uses a heavy attachment making a motion which tends to suddenly change, and the like. On the other hand, the changeover to the responsiveness priority mode is set valid in the excavation mode 231, the tilt bucket mode 236, the skeleton bucket mode 237, and the like because of a probability that the action requiring responsiveness such as a crushed substance sieve action and the gravel spreading action is performed.

The other configurations are similar to those in Embodiments 1 to 3.

The present modification configured as described so far can obtain similar advantages to those of Embodiments 1 to 3.

Furthermore, the responsiveness priority mode can be made invalid in the predetermined work modes; thus, the changeover to the responsiveness priority mode can be set invalid and operability can be improved in the work mode requiring the delicate action and the work mode using the heavy attachment making the motion which tends to suddenly change.

Features of Embodiments 1 to 3 and the modification will next be described.

(1) According to Embodiments 1, 2, 3, and the modification, the work machine includes: the hydraulic pump 41 driven by the prime mover (for example, the engine 22); the multijoint type front work implement 30 configured such that a plurality of driven members including at least the boom 31, the arm 33, and the work tool (for example, the bucket 35) are coupled rotatably; a plurality of hydraulic actuators (for example, the boom cylinder 32, the arm cylinder 34, and the bucket cylinder 36) each driven by the pressurized fluid delivered from the hydraulic pump and driving each of the plurality of driven members; a plurality of directional control valves 43 and 44 each controlling a direction and a flow rate of the pressurized fluid supplied from the hydraulic pump to each of the plurality of hydraulic actuators; a plurality of operation devices (for example, the operation lever devices 51 and 52) controlling the plurality of directional control valves; the operation amount sensors 51*a*, 52*a*, and 52*b* detecting the operation amounts of the operation devices related to at least the boom and the work tool among the plurality of operation devices; the flow restriction device (for example, the variable flow control valve 45; 46, the pressure reducing valves 47*a*, 47*b*) that can restrict a flow rate of the pressurized fluid in at least one of the meter-in passage and the meter-out passage of one of the directional control valves, the one directional control valve being related to the work tool; and the controller 60; 60A; 60B; 60C controlling the flow restriction device on the basis of the detection results of the operation amounts from the plurality of operation amount sensors, the controller being configured to be capable of changing over the action mode to any one of the normal mode for restricting a flow rate of the pressurized fluid by the flow restriction device and the responsiveness priority mode for not restricting the flow rate of the pressurized fluid by the flow restriction device in response to the detection results of the operation amounts of the plurality of operation devices.

It is thereby possible to enhance the responsiveness in the action requiring the responsiveness such as the action in which the operation amount of the operation lever frequently changes in a short period of time without deteriorating workability during the normal operation, and to suppress a decline in work efficiency.

(2) Furthermore, according to Embodiment 1, in the work machine of (1), the flow restriction device is the variable flow control valve 45 disposed in the supply hydraulic line between the meter-in passage of the directional control valve related to the work tool and the hydraulic pump.

(3) Furthermore, according to Embodiment 2, in the work machine of (1), the flow restriction device is the variable flow control valve 46 disposed in the return hydraulic line between the meter-out passage of the directional control valve related to the work tool and the hydraulic fluid tank.

It is thereby possible to make smaller the opening area of the variable flow control valve 46 as the thrust that acts on the piston of the bucket cylinder 36 is greater, and to suppress the cylinder speed of the bucket cylinder 36 to prevent cavitation, in the case in which the direction of the thrust is opposite to that of the thrust estimated from the operating direction of the operation lever device 52.

(4) Moreover, according to Embodiment 3, in the work machine of (1), the flow restriction device is the pressure reducing valves 47*a* and 47*b* disposed in the pilot hydraulic lines between one of the operation devices, the one operation device being related to the work tool, and the directional control valve related to the work tool.

It is thereby possible to make smaller the opening area of the meter-out side of the directional control valve 44 as the thrust that acts on the piston of the bucket cylinder 36 is greater, and to suppress the cylinder speed of the bucket cylinder 36 to prevent cavitation, in the case in which the direction of the thrust is opposite to that of the thrust estimated from the operating direction of the operation lever device 52.

(5) Furthermore, according to Embodiments 1, 2, 3, and the modification, in the work machine of (1), the controller changes over the action mode to the responsiveness priority mode for not restricting the flow rate of the pressurized fluid by the flow restriction device in the case in which a number of times, by which an operation amount of one of the operation devices increases to exceed the preset threshold within the preset fixed time, exceeds the preset number of times.

(6) Moreover, according to the modification, the work machine of (1) includes the work mode setting device 63 that sets the work mode in response to the content of the work performed by the front work implement, and the controller does not change over the action mode to the responsiveness priority mode in the case in which it is preset to make the responsiveness priority mode invalid for the work mode set by the work mode setting device.

The responsiveness priority mode can be thereby made invalid in the predetermined work modes; thus, the changeover to the responsiveness priority mode can be set invalid and operability can be improved in the work mode requiring the delicate action and the work mode using the heavy attachment making the motion which tends to suddenly change.

<Note>

It is noted that the ordinary hydraulic excavator that drives the hydraulic pump by the prime mover such as the engine has been described in Embodiments 1 to 3 and the modification by way of example. Needless to say, the present invention can be applied to a hybrid hydraulic excavator that drives a hydraulic pump by an engine and a motor, a motorized hydraulic excavator that drives a hydraulic pump only by a motor, or the other hydraulic excavator.

Moreover, the pump volume target value computing section 61 has been described while taking the case of controlling the delivery flow rate of the hydraulic pump 41 on the basis of the boom raising operation amount, the bucket crowding operation amount, and the bucket dumping operation amount by way of example. However, the pump volume target value computing section 61 is not limited to this example, and may be configured, for example, such that the delivery flow rate of the hydraulic pump 41 is controlled on the basis of a boom lowering operation amount, an arm crowding operation amount, an arm dumping operation amount, left and right swing operation amounts of the upper swing structure 20, and the like.

Furthermore, the present invention is not limited to Embodiments 1 to 3 and the modification but encompasses various modifications and combinations without departing from the gist of the invention. Moreover, the present invention is not limited to the work machine that includes all the configurations described in Embodiments 1 to 3 and the modification but encompasses those from which a part of the configurations is deleted. Furthermore, the configurations, the functions, and the like described above may be realized by, for example, designing a part or all thereof with integrated circuits. Moreover, the configurations, functions, and the like described above may be realized by software by causing a processor to interpret and execute programs that realize the respective functions.

DESCRIPTION OF REFERENCE CHARACTERS

10: Lower travel structure
11*a* (11*b*): Crawler
12*a* (12*b*): Crawler frame
13*a* (13*b*): Travel hydraulic motor
13*b:* Travel hydraulic motor
20: Upper swing structure
21: Swing frame
22: Engine
23: Cabin (cabinet)
26: Speed reduction mechanism
27: Swing hydraulic motor
30: Front device (front work implement)
31: Boom
32: Boom cylinder
32*a:* Boom cylinder bottom chamber
32*b:* Boom cylinder rod chamber
33: Arm
34: Arm cylinder
35: Bucket
36: Bucket cylinder
36*a:* Bucket cylinder bottom chamber
36*b:* Bucket cylinder rod chamber
40, 40A, 40B: Hydraulic circuit system
41: Hydraulic pump
41*a:* Center bypass hydraulic line
41*b*, 41*c:* Supply hydraulic line
42: Regulator
43, 44: Directional control valve (spool)
43*a*, 44*a:* Check valve
44*b*, 44*c:* Pressure sensor
45, 46: Variable flow control valve (flow restriction device)
47*a*, 47*b:* Pressure reducing valve (flow restriction device)
45*a*, 46*a:* Solenoid proportional valve
48: Hydraulic fluid tank
48*a*, 48*b:* Return hydraulic line
49: Pilot pump (pilot hydraulic fluid source)
51, 52: Operation lever device (operation device)
51*a*, 52*a*, 52*b: Operation amount sensor*
60, 60A, 60B: Controller
61: Pump volume target value computing section
62, 62A, 62C: Variable flow control valve opening area target value computing section
62B: Directional control valve opening area target value computing section
63: Input/output device (work mode setting device)
63*a:* Monitor (display device)
63*b:* Operation switch group
100: Hydraulic excavator (work machine)
101-103, 111-114, 123, 124: Computing section
104, 115, 116, 118: Maximum value selection section
117, 125-127: Minimum value selection section
119: Mode determination section
119*a:* Valid/invalid changeover section
120, 120*a*, 120*b:* Opening area maximum value
121, 131, 132: Output value changeover section
122: Cylinder thrust computing section
200: Main menu
210: Information menu
220: Setting menu
230: Work mode setting menu

The invention claimed is:

1. A work machine comprising:

a hydraulic pump driven by a prime mover;

a multijoint type front work implement configured such that a plurality of driven members including at least a boom, an arm, and a work tool are coupled rotatably;

a plurality of hydraulic actuators each driven by a pressurized fluid delivered from the hydraulic pump and driving each of the plurality of driven members;

a plurality of directional control valves each controlling a direction and a flow rate of the pressurized fluid supplied from the hydraulic pump to each of the plurality of hydraulic actuators;

a plurality of operation devices controlling the plurality of directional control valves;

a plurality of operation amount sensors detecting operation amounts of the operation devices related to at least the boom and the work tool among the plurality of operation devices;

a flow restriction device that can restrict a flow rate of the pressurized fluid in at least one of a meter-in passage and a meter-out passage of one of the directional control valves, the one directional control valve being related to the work tool; and a controller controlling the flow restriction device on the basis of detection results of operation amounts from the plurality of operation amount sensors, wherein the controller is configured to be capable of changing over an action mode to any one of a normal mode for restricting a flow rate of the pressurized fluid by the flow restriction device and a responsiveness priority mode for not restricting the flow rate of the pressurized fluid by the flow restriction device in response to the detection results of the operation amounts of the plurality of operation devices.

2. The work machine according to claim 1, wherein the flow restriction device is a variable flow control valve disposed in a supply hydraulic line between the meter-in passage of the directional control valve related to the work tool and the hydraulic pump.

3. The work machine according to claim 1, wherein the flow restriction device is a variable flow control valve disposed in a return hydraulic line between the meter-out passage of the directional control valve related to the work tool and a hydraulic fluid tank.

4. The work machine according to claim 1, wherein the flow restriction device is pressure reducing valves disposed in pilot hydraulic lines between one of the operation devices, the one operation device being related to the work tool, and the directional control valve related to the work tool.

5. The work machine according to claim 1, wherein the controller changes over the action mode to the responsiveness priority mode for not restricting the flow rate of the pressurized fluid by the flow restriction device in a case in which a number of times, by which an operation amount of one of the operation devices increases to exceed a preset threshold within preset fixed time, exceeds a preset number of times.

6. The work machine according to claim 1, including a work mode setting device that sets a work mode in response to a content of work performed by the front work implement, wherein the controller does not change over the action mode to the responsiveness priority mode in a case in which it is preset to make the responsiveness priority mode invalid for the work mode set by the work mode setting device.

* * * * *